US009486824B2

(12) United States Patent
Uschold et al.

(10) Patent No.: US 9,486,824 B2
(45) Date of Patent: Nov. 8, 2016

(54) DISPENSER DEVICE AND CONTAINER

(75) Inventors: Robert C. Uschold, Leominster, MA (US); Jeffrey A. Karg, Hopkinton, MA (US); Christopher M. Catinella, Marlborough, MA (US); Vito Lore, Somerville, MA (US)

(73) Assignee: WOODS DISPENSING SYSTEMS, LLC, Toledo, OH (US)

( * ) Notice: Subject to any disclaimer, the term of this patent is extended or adjusted under 35 U.S.C. 154(b) by 964 days.

(21) Appl. No.: 13/582,480

(22) PCT Filed: Mar. 9, 2011

(86) PCT No.: PCT/US2011/027743

§ 371 (c)(1),
(2), (4) Date: Oct. 23, 2012

(87) PCT Pub. No.: WO2011/112711

PCT Pub. Date: Sep. 15, 2011

(65) Prior Publication Data

US 2013/0193226 A1 Aug. 1, 2013

Related U.S. Application Data

(60) Provisional application No. 61/311,829, filed on Mar. 9, 2010.

(51) Int. Cl.
*B05B 9/01* (2006.01)
*B05B 7/12* (2006.01)
(Continued)

(52) U.S. Cl.
CPC ..... *B05B 9/01* (2013.01); *B01F 5/043* (2013.01); *B01F 5/0413* (2013.01); *B01F 5/0496* (2013.01); *B01F 13/002* (2013.01);
(Continued)

(58) Field of Classification Search
CPC ..... B05B 9/01; B05B 7/12; B05B 12/002; B01F 5/043; B05C 17/022
USPC ..... 239/10
See application file for complete search history.

(56) References Cited

U.S. PATENT DOCUMENTS 2,719,704 A * 10/1955 Anderson ..... A47L 15/4427 137/599.03
2,781,061 A * 2/1957 Frey ..... D06F 39/088 137/517

(Continued)

FOREIGN PATENT DOCUMENTS

CN 1919473 A 2/2007
JP H08299865 A 11/1996

OTHER PUBLICATIONS

Chinese Office Action dated May 6, 2015; Application No. 201180023328.X; Applicant: Woods Dispensing Systems, LLC; 7 pages.

(Continued)

*Primary Examiner* — Arthur O Hall
*Assistant Examiner* — Chee-Chong Lee
(74) *Attorney, Agent, or Firm* — Shumaker, Loop & Kendrick, LLP

(57) ABSTRACT

One embodiment includes a dispenser device and container for mixing a chemical concentrate and a diluent to produce a diluted mixture. The dispenser device may include a housing, a slide, and an eductor. The container holds the chemical concentrate. The dispenser device communicates with the chemical concentrate and with the diluent.

4 Claims, 28 Drawing Sheets

(51) Int. Cl.

| | |
|---|---|
| ***B01F 5/04*** | (2006.01) |
| ***B01F 13/00*** | (2006.01) |
| ***B05B 1/30*** | (2006.01) |
| ***B05B 12/00*** | (2006.01) |
| ***B05C 17/02*** | (2006.01) |

(52) U.S. Cl.
CPC ..... *B01F13/0027* (2013.01); *B05B 1/304* (2013.01); *B05B 7/12* (2013.01); *B05B 12/002* (2013.01); *B05C 17/022* (2013.01)

(56) References Cited

U.S. PATENT DOCUMENTS 2,788,244 A * 4/1957 Gilmour ..... B05B 7/12 137/889
2,991,939 A * 7/1961 Packard ..... B05B 7/12 239/114
3,145,735 A * 8/1964 Osrow ..... G05D 7/0146 137/625.12
3,228,613 A * 1/1966 Goldstein ..... A47L 13/26 137/268
6,378,789 B1 4/2002 Seaman, Jr. et al.
6,988,675 B2 * 1/2006 Hubmann ..... B01F 5/0413 239/302
2002/0092925 A1 * 7/2002 Hubmann ..... B01F 5/0413 239/310

OTHER PUBLICATIONS

Chinese Office Action dated Nov. 4, 2014; Application No. 201180023328.X; Applicant : Woods Dispensing Systems, LLC ; 16 pages.

* cited by examiner

DISPENSER DEVICE AND CONTAINER

This application claims the benefit of U.S. Provisional Application No. 61/311,829 filed Mar. 9, 2010.

TECHNICAL FIELD

The technical field generally relates to products including dispensers and containers, and to dispenser devices used for mixing chemical concentrate with a diluent in order to produce a diluted mixture.

BACKGROUND

Dispenser devices are often used for mixing a chemical concentrate, such as a cleaning solution concentrate, with a diluent, such as water, in order to produce a diluted mixture. In the case of the cleaning solution and water, a dispenser device is commonly connected to a container which holds cleaning solution concentrate, and is also connected to a hose or other source which discharges pressurized water. The cleaning solution concentrate and the water mix at a desired ratio of diluent-to-concentrate and the resulting diluted mixture is usually discharged from the dispenser device and into an awaiting portable bottle, bucket, or other receptacle. The receptacle can then be carried away by cleaning personnel in order to be used for cleaning rooms of a building, for example. Such dispenser devices are sometimes a part of a wall-mounted cleaning station that is located in the building to be cleaned. Dispenser devices can also be used to spray a diluted mixture directly onto a dirty surface and not necessarily into a receptacle.

SUMMARY OF ILLUSTRATIVE EMBODIMENTS

One embodiment includes a product including a dispenser device. The dispenser device may be used to mix chemical concentrate with a diluent in order to produce a diluted mixture. The dispenser device may include an eductor, a flow valve, and a slide. The eductor may have a primary passage with an inlet for receiving the diluent, and the primary passage may have an outlet for discharging the diluted mixture. The eductor may have one or more passages for receiving the chemical concentrate. The one or more passages may communicate with the primary passage. The flow valve may open to permit diluent flow to the eductor, and may close to prevent diluent flow near the inlet of the eductor. During use, the eductor may rotate about its longitudinal axis in order to bring the one or more passages in circumferential alignment with an inlet through which the chemical concentrate is drawn. And the slide may move linearly along the longitudinal axis of the eductor in order to cause the flow valve to open.

One embodiment includes a method. The method may include providing a dispenser device that mixes chemical concentrate with a diluent to produce a diluted mixture. The dispenser device may include an eductor, a flow valve, and a sleeve. The eductor may have a primary passage with an inlet, and the eductor may have one or more passages communicating with the primary passage in order to receive the chemical concentrate. The flow valve may open and close in order to permit and prevent diluent flow at the inlet of the eductor. And the sleeve may partially or more surround a portion or more of the eductor. The method may include rotating the eductor about its longitudinal axis in order to bring the one or more passages in circumferential alignment with an inlet through which the chemical concentrate is drawn. The method may include moving the sleeve linearly along the longitudinal axis of the eductor in order to move the flow valve open and let diluent flow into the primary passage.

One embodiment may include an eductor which may have a primary passage with an inlet for receiving the diluent and an outlet for discharging the diluted mixture. The eductor may have one or more passages for receiving the chemical concentrate. The passages may communicate with the primary passage. The embodiment may further include a slide and a trigger, the trigger may be constructed and arranged to cause the slide to move linearly along the longitudinal axis of the eductor.

One embodiment may include an eductor which may have a primary passage with an inlet for receiving the diluent and an outlet for discharging the diluted mixture. The eductor may have at least one passage for receiving the chemical concentrate, the at least one passage may communicate with the primary passage. The embodiment may further include a flow valve opening and closing to respectively permit and prevent diluent flow to the eductor. The flow valve may have a plug portion inserted into the primary passage of the eductor when in the closed position.

One embodiment may include an eductor which may have a primary passage with an inlet for receiving the diluent and an outlet for discharging the diluted mixture. The eductor may have at least one passage for receiving the chemical concentrate, the at least one passage may communicate with the primary passage. The embodiment may further include a slide which may be constructed and arranged to move linearly along the longitudinal axis of the eductor. At least one of the slide, the eductor, or both may have at least one indexing feature constructed and arranged to selectively restrict the linear longitudinal movement of the slide.

One embodiment may include an eductor which may have a primary passage with an inlet for receiving the diluent and an outlet for discharging the diluted mixture. The eductor may have at least one passage for receiving the chemical concentrate, the at least one passage may communicate with the primary passage. The embodiment may also include a slide which may be constructed and arranged to move linearly along the longitudinal axis of the eductor. The slide may include a nub. The embodiment may also include a trigger constructed and arranged so that a portion of the trigger may directly engage the nub to cause the slide to move linearly along the longitudinal axis of the eductor.

One embodiment may include an eductor having a primary passage with an inlet for receiving the diluent and an outlet for discharging the diluted mixture. The eductor may have at least one passage for receiving the chemical concentrate. The at least one passage may communicate with the primary passage. The eductor may comprise a first component and a passage component that is a separate and distinct component with respect to the first component. The first component may comprise the primary passage and the passage component may define at least a portion of the at least one passage. The first component may have a male portion received in a female portion of the passage component.

One embodiment may include a passage component for a dispensing eductor. The passage component may comprise a body having at least one groove located at a radially-outwardly-most surface of the body. The at least one groove may have a first open end in a radially-outwardly direction thereof and may have a second open end in an axially-forwardly direction thereof.

BRIEF DESCRIPTION OF THE DRAWINGS

Illustrative embodiments of the invention will become more fully understood from the detailed description and the accompanying drawings, wherein.

DETAILED DESCRIPTION OF ILLUSTRATIVE EMBODIMENTS

Figure 1:
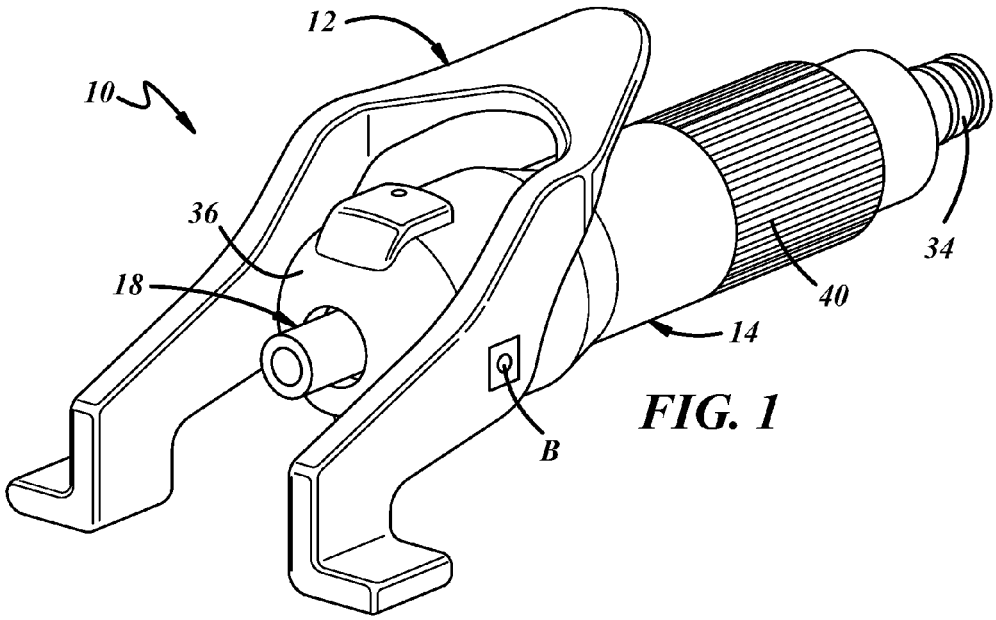
FIG. 1 is a perspective view of an illustrative embodiment of a dispenser device.

The following description of the embodiment(s) is merely illustrative in nature and is in no way intended to limit the invention, its application, or uses. Furthermore, cross-hatching or cross-sectional lines provided in the drawings is merely illustrative in nature and is not intended to emphasize a particular part or portion, and is not intended to designate a particular material for a particular part or portion.

The figures show several illustrative embodiments of a dispenser device that may be used to mix a chemical concentrate, such as a cleaning solution concentrate, with a diluent, such as water, in order to produce a diluted mixture. The dispenser device may be but one component of a wall-mounted cleaning station and system (not shown) in which numerous dispenser devices are provided. The dispenser device may be designed for use to fill a smaller spray bottle, a larger bucket, another receptacle, and/or to spray diluted mixture directly onto a dirty surface.

In the illustrated embodiments, components of the dispenser device have a generally cylindrical shape that defines various directions with respect to the shape. For example, radially refers to a direction that is generally along an imaginary radius of the shape, axially refers to a direction that is generally parallel to an imaginary center axis of the shape, and circumferentially refers to a direction that is generally along an imaginary circumference of the shape.

In one illustrative embodiment of FIGS. 1-8, a dispenser device 10 may include a trigger 12, a housing 14, a slide which in one embodiment may be a sleeve 16, an eductor 18, and a flow valve 20. The trigger 12 may be pressed in order to actuate the dispenser device 10, which may let in pressurized water from a hose (not shown) and may allow cleaning solution concentrate to be drawn into the dispenser device from a container under certain circumstances. The trigger 12 may have various designs and constructions, including that shown in FIGS. 1-3. The trigger 12 may be indirectly connected to a rocker 22 via one or more linking structures, or may be directly connected to the rocker via a weld, press-fit, or other interconnection. In use, an operator presses the trigger 12 in a direction A whereupon the trigger pivots about a pivot point B and causes the rocker 22 to turn in a direction C. The trigger 12 is shown in the unactuated position in FIGS. 1 and 2, and is shown fully actuated in FIG. 3.

Figure 8:
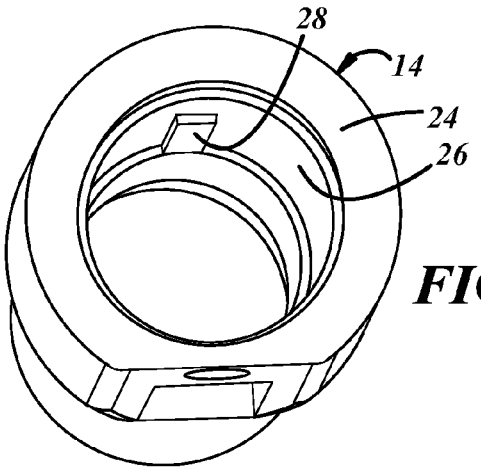
FIG. 8 is a perspective view of an illustrative embodiment of a portion of a housing of the dispenser device of FIG. 1.

The housing 14 may surround the sleeve 16, the eductor 18, and the flow valve 20, and may support the structures thereof. The housing 14 may also facilitate connection to a diluent source, such as connection to a water hose, and connection to a chemical concentrate source, such as connection to the container. The housing 14 may have various designs and constructions, including that shown in FIGS. 1-4 and 8. The housing 14 may have a first body 24 with a bore 26 having a generally cylindrical shape (FIG. 8). A projection 28 may be located in the bore 26 and may interact with a complementary shaped recess after assembly and during use of the dispenser device 10, as will be subsequently described. The projection 28 may be radially inwardly directed. The housing 14 may also include a second body 30 that may be telescoped partly within the first body 24 and connected thereto. A connector 32 with a female thread may extend from the second body 30 and may mate with a male threaded coupler 34 which may be used for coupling to the water hose—each of these components may also be a part of the housing 14. The housing 14 may further include an end cap 36 which itself may have an opening 38 through which an end of the eductor 18 may protrude.

The housing 14 may also include a collar 40 and a plate 42. The collar 40 may be rotatable during use of the dispenser device 10 and thus may have a ribbed outer surface or another feature which facilitates rotation thereof by the user. In use, the collar 40 may interact with the eductor 18, as will be subsequently described. The collar 40 may rotate about a longitudinal axis D of the eductor 18. The plate 42 may face an inside of the container of cleaning solution concentrate, and may communicate the concentrate to the dispenser device 10. The plate 42 may have an inlet bore 44 for passage of the concentrate, and may have a vent bore 46 for relieving a resulting partial vacuum which may develop in the container.

The slide may slide upon actuation of the dispenser device 10 and may cause the flow valve 20 to open and close. The slide may have various designs and constructions, including the sleeve 16 of FIGS. 2, 3, 5, and 7. In other embodiments, the slide may comprises one or more rods, bars, or other structures that may have at least a portion thereof guided in a slot or groove for controlled linear movement, for example. In the illustrative embodiment, the sleeve 16 may have a generally cylindrical body with a bore 48 extending therethrough. The sleeve 16 may surround a portion or more of the eductor 18 in a telescopic and concentric relationship with the portion or more of the eductor located within the interior of the sleeve, while a number of gaskets and bearings may be located between the sleeve and the eductor to facilitate sealing and frictionless movement therebetween. At a first end 50, the sleeve 16 may directly abut the flow valve 20 and may maintain direct contact therewith throughout opening and closing movements of the flow valve, as will be subsequently described. A number of finger-like structures 52 may be located at the first end 50, and spaces 54 may be located between each finger-like structure to permit the passage of diluent therethrough when the flow valve 20 is held in the open position by the sleeve 16. The finger-like structures 52 may be located circumferentially offset with respect to one another and with a single space 54 between a pair of neighboring finger-like structures. The finger-like structures 52 and the spaces 54 may constitute one axial terminal end of the sleeve 16. The sleeve 16 may include a gasket 56 which may be seated therein and which, in use, may move linearly longitudinally (i.e., along the longitudinal axis D) with the sleeve. The gasket 56 may be seated and trapped in a recess provided in the wall of the sleeve 16. The gasket 56 may have an inlet passage 58 and a vent passage 60. Under certain circumstances, the inlet passage 58 may communicate with the inlet bore 44, while the vent passage 60 may communicate with the vent bore 46. The vent passage 60 may communicate outside of the structure of the dispenser device 10 and may communicate with the atmosphere via passages 62 formed in part by the sleeve 16 and by the housing 14.

The sleeve 16 may also include an indexing feature such as a first cutout 64, a second cutout 66, and a third cutout 68, all of which may communicate with one another and may be located near the first end 50. The first, second, and third cutouts 64, 66, 68 may be provided in the wall of the sleeve 16. The first, second, and third cutouts 64, 66, 68 may each have its own longitudinal length measured in a direction parallel to the longitudinal axis D of the eductor 18. For example, the first cutout 64 may have a first longitudinal length that is less than a third longitudinal length of the third cutout 68, and a second longitudinal length of the second cutout 66 may be less than the first longitudinal length. In use, the sleeve 16 may slide linearly longitudinally and back-and-forth in a direction E, and may move independently of the eductor 18. The sleeve 16 may not rotate. Rotation may be prevented by way of complementary interengaging structures of the sleeve 16 and of the housing 14; for example, in assembly the projection 28 of the housing 14 may be inserted into a recess 70 (FIG. 7) that may be located in the outer surface of the sleeve. The interengaging projection 28 and recess 70 may permit linear longitudinal reciprocation of the sleeve 16 with respect to the housing 14, and may check and prevent rotational movement between the sleeve and the housing. The interengaging projection 28 and recess 70 may also serve as a pilot for angular positioning of the sleeve 16 and the housing 14. At rest and unactuated, the sleeve 16 may be biased in a forward-most position (FIG. 2) via a spring 72 where the flow valve 20 is in a closed and sealed position. The sleeve may have other embodiments that are not shown in the figures; for example, the sleeve need not fully circumferentially surround the eductor whereby only a portion of the sleeve would surround the eductor, while another portion of the sleeve does not surround the eductor, while another portion of the sleeve does not surround the eductor, the sleeve need not have exactly three cutouts and instead could have two or four cutouts, and the sleeve need not make and maintain direct abutment with the valve and instead could cause valve movement via an intermediate structure.

The eductor 18 may direct incoming diluent flow and incoming chemical concentrate flow to an intersection where the fluids may mix with each other and produce the diluted mixture. The eductor 18 may have various designs and constructions, including that shown in FIGS. 2, 3, and 6. In some designs and constructions, the eductor may be made of separate and distinct parts that are put together in assembly; this may be due to manufacturing limitations. In the illustrated embodiment, the eductor 18 may have a generally cylindrical shape and may be telescoped partially within the sleeve 16. The eductor 18 may have an inlet end 74 with a generally narrowing cone-shape in the forward fluid-flow direction for receiving diluent when the flow valve 20 is opened, and may have a discharge end 76 with a generally widening cone-shape in the forward direction for discharging the resulting diluted mixture. The discharge end 76 may protrude and may be exposed outside of the end cap 36. The eductor 18 may have a primary passage 78 extending between and communicating with the inlet end 74 and the discharge end 76, may have a first passage 80 intersecting perpendicularly and communicating with the primary passage, and may have a second passage 82 intersecting perpendicularly and communicating with the primary passage. A first orifice plate 84 may be located in the first passage 80, and a second orifice plate (not shown) may be located in the second passage 82. The first orifice plate 84 may be sized and dimensioned to permit a first predetermined volumetric flow rate of chemical concentrate therethrough, and the second orifice plate may be sized and dimensioned to permit a second predetermined volumetric flow rate of chemical concentrate therethrough. The second predetermined volumetric flow rate may be greater than the first predetermined volumetric flow rate. The first and second orifice plates may be components that are separately manufactured than the eductor 18 and subsequently assembled therewith, meaning that the orifice plates may be made in a comparatively more precise manufacturing process. In use, the eductor 18 may rotate about its longitudinal axis D, and may not slide linearly longitudinally in the direction of the longitudinal axis.

Figure 5:
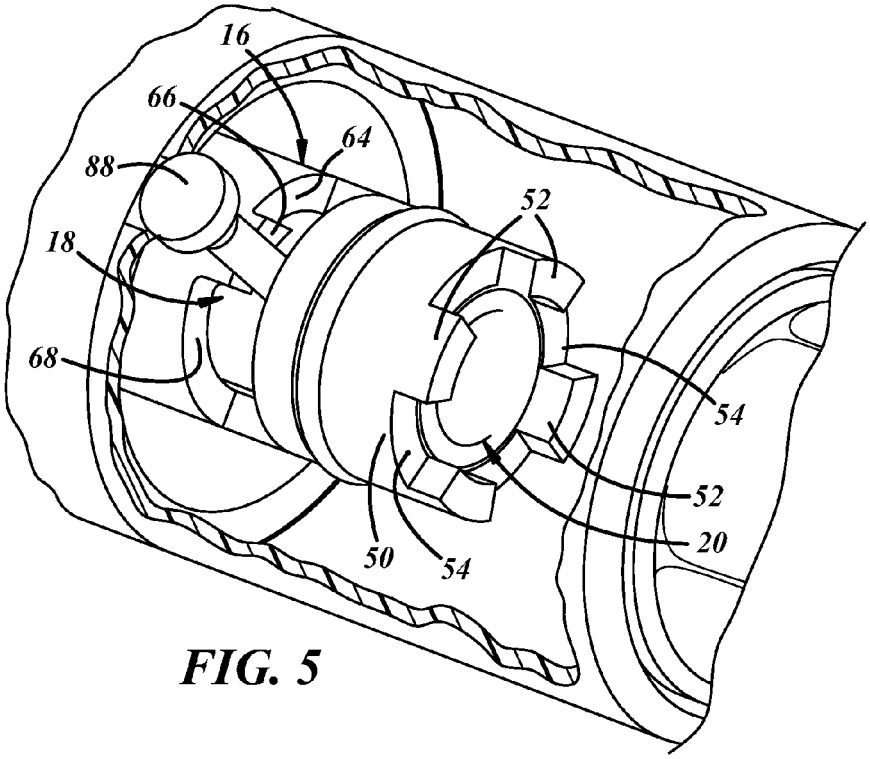
FIG. 5 is an enlarged view of internal components of the dispenser device of FIG. 1.
Figure 3:
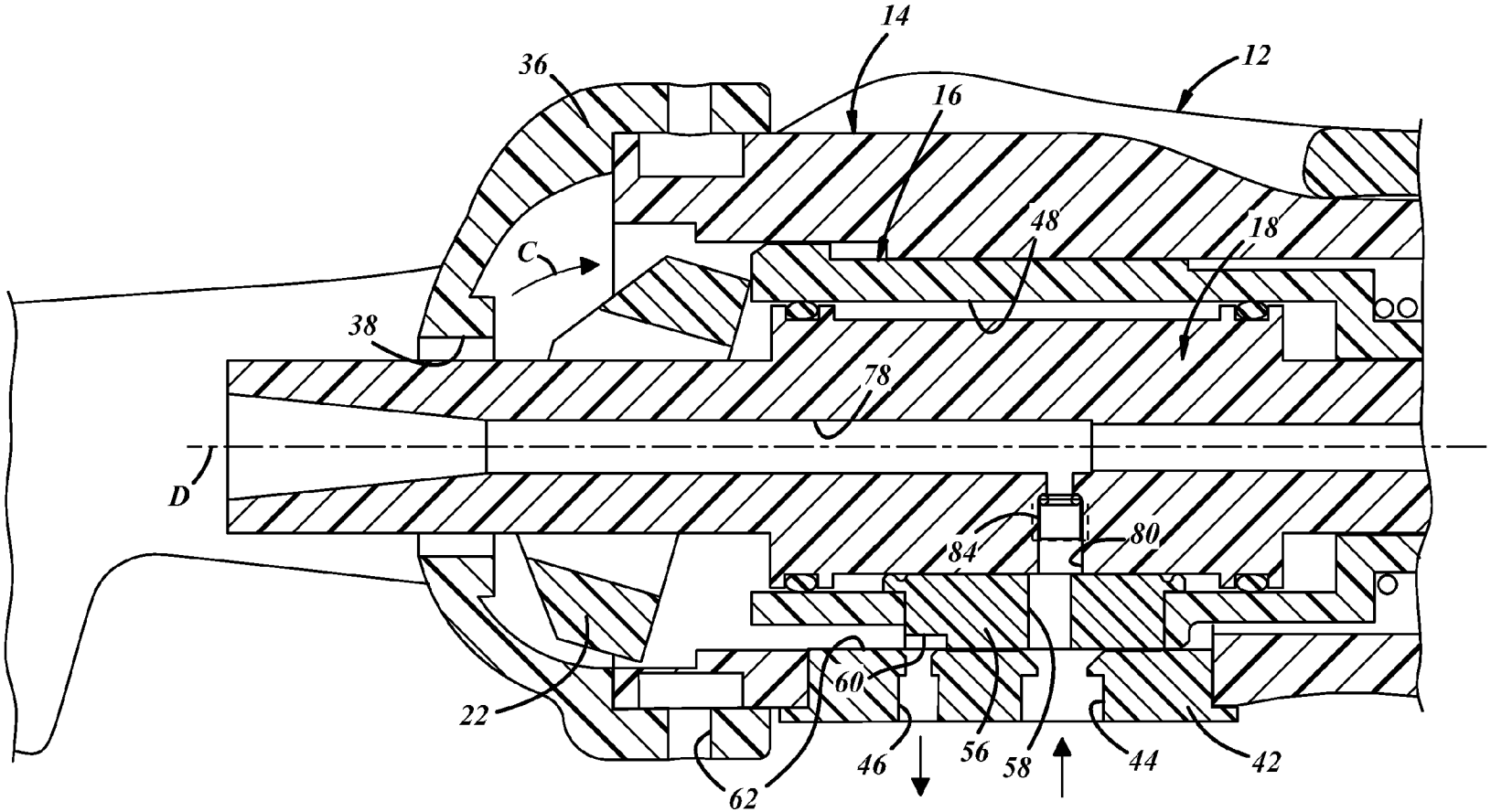
FIG. 3 is an enlarged cross-sectional view of the dispenser device of FIG. 1.
Figure 4:
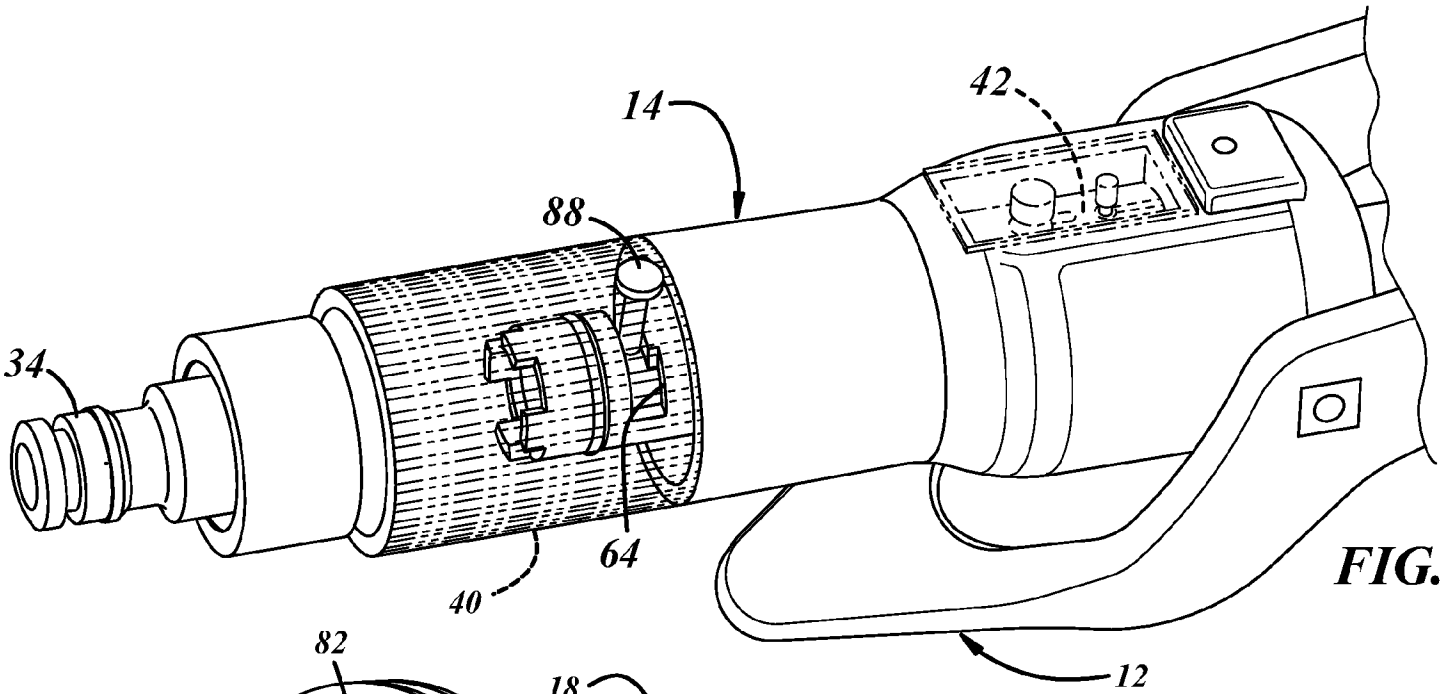
FIG. 4 is a perspective view of the dispenser device of FIG. 1, showing an illustrative embodiment of a collar in phantom.
Figure 6:
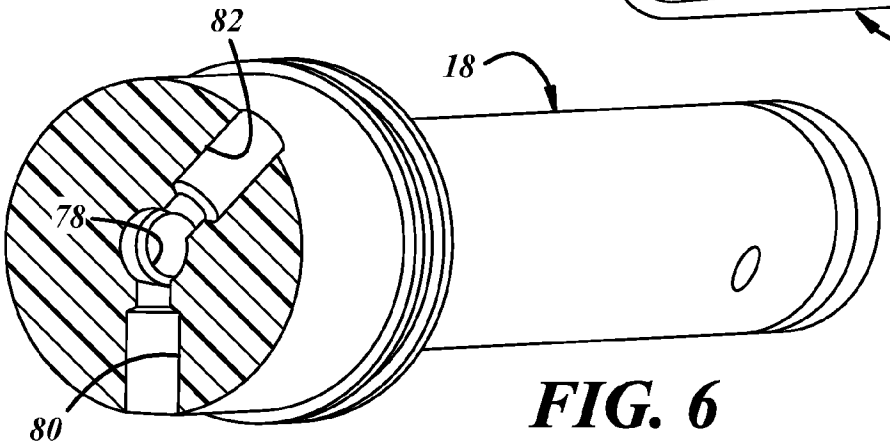
FIG. 6 is a cross-sectional view of an illustrative embodiment of an eductor of the dispenser device of FIG. 1.

Referring now to FIGS. 4 and 5, the eductor 18 may have a fixed connection to the collar 40 by way of a pin 88 so that as the collar rotates, the eductor also rotates. The fixed connection may also prevent or facilitate preventing linear longitudinal movement of the eductor 18 because the collar 40 may not itself move in the longitudinal direction. The pin 88 may extend from the collar 40 and to the eductor 18 through one or more of the cutouts 64, 66, 68 of the sleeve 16. The eductor may have other embodiments that are not shown in FIGS. 1-8; for example, the eductor can have greater than two passages that intersect the primary passage, the orifice plates need not be provided whereby a formed orifice in the respective passages serves the function of the orifice plates, and the eductor could be connected to the collar via other structures and in other ways such as a unitary extension from the collar and/or from the eductor.

The flow valve 20 may regulate diluent fluid-flow into the primary passage 78 of the eductor 18. The flow valve 20 may have various designs and constructions, including that shown in FIGS. 2, 4, and 5. In the illustrated embodiment, the flow valve 20 may be located adjacent the inlet end 74 of the eductor 18 and may open and close to permit and prevent diluent fluid-flow therethrough, including permitting diluents fluid-flow in varying degrees between fully closed and fully open. The flow valve 20 may have an o-ring 90 to facilitate sealing of the valve when it is in the fully closed position. In use, the flow valve 20 may be opened and closed via linear longitudinal reciprocation of the sleeve 16 which may produce openings between the finger-like structures 52, the spaces 54, and the flow valve through which diluent flows. Pressure may be generated by pressurized diluent flow which may bias the flow valve 20 in the closed position when unactuated. The flow valve may have other embodiments that are not shown in the figures; for example, the flow valve could be open and closed in a way other than linear longitudinal movement by way of an intermediate structure between the sleeve and the valve.

In the case of a cleaning solution concentrate, the dispenser device 10 may be but one component of a larger wall-mounted cleaning station assembly and system that may also include a wall-mounted unit for carrying and storing multiple containers of cleaning solution concentrate, multiple sources of pressurized diluent, and multiple dispenser devices. Also, a single dispenser device 10 may be connected to a single container of cleaning solution concentrate, and a single pressurized water hose may be connected to the single dispenser device. The container of cleaning solution concentrate may be connected to the dispenser device 10 where it would interact and communicate with the plate 42 by way of a connecting structure (not shown in FIGS. 1-8) such as, for example, a threaded connection, a press-fit connection, a snap-on connection, and/or the container may be a unitary extension of the dispenser device. The source of pressurized water may be connected to the dispenser device 10 at the coupler 34 by way of, for example, a threaded hose connection, a press-fit connection, a snap-on connection, and/or the source of pressurized water may be a unitary extension of the dispenser device such as a hose extending therefrom. A bottle, bucket, or other receptacle may be placed at the discharge end 76 in order to receive the diluted mixture; in some examples, the discharge end may protrude away from the housing 14 at an angle to facilitate for such a filling, or another structure such as a tube may be connected to the discharge end.

Figure 2:
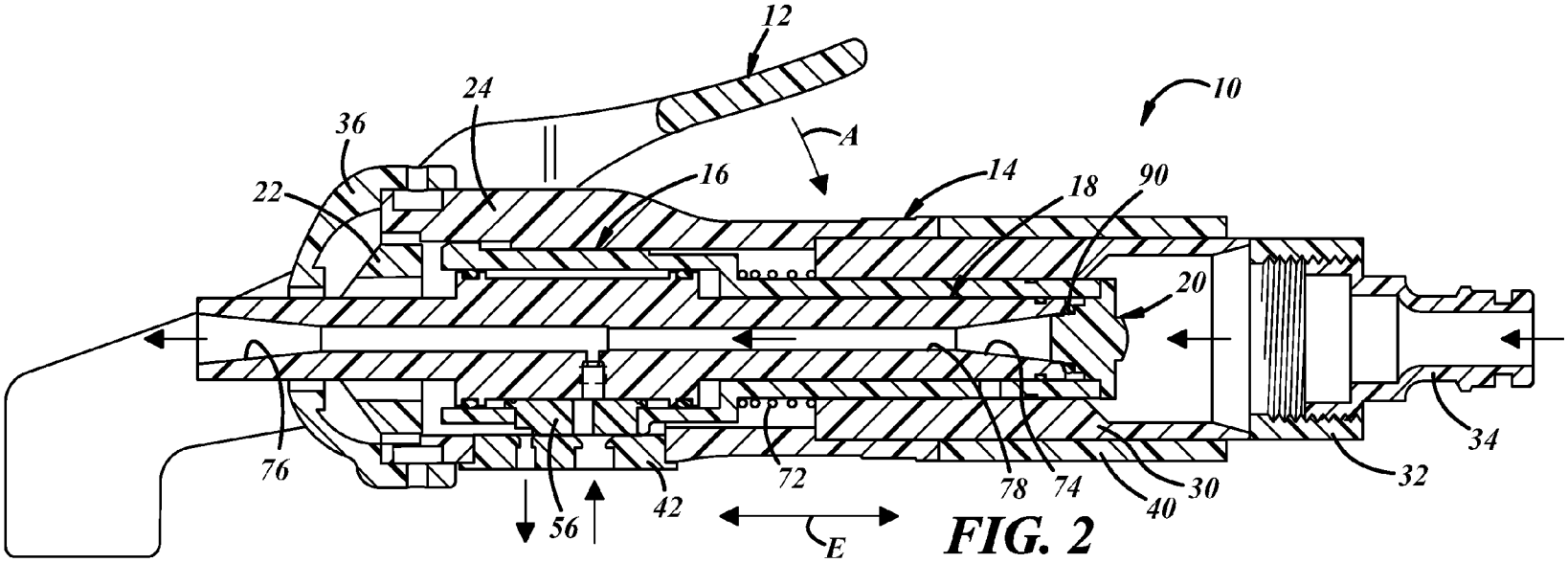
FIG. 2 is a cross-sectional view of the dispenser device of FIG. 1.
Figure 7:
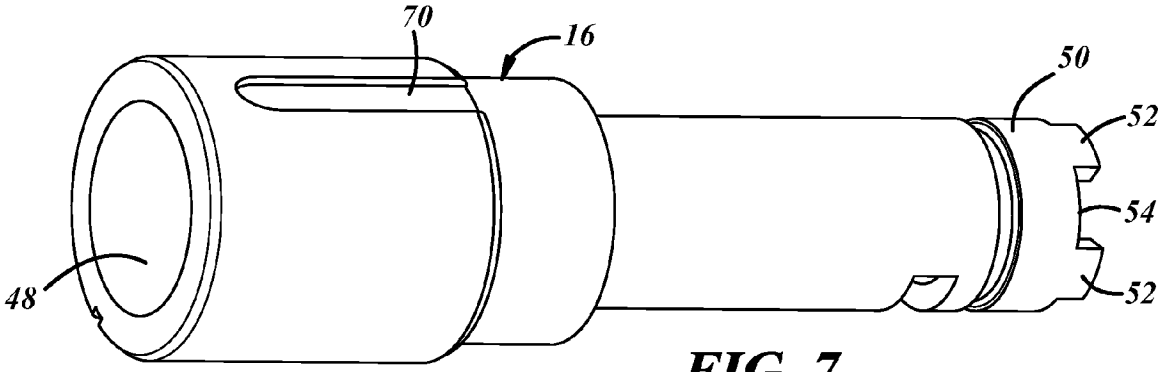
FIG. 7 is a perspective view of an illustrative embodiment of a sleeve of the dispenser device of FIG. 1.

Referring to FIGS. 2 and 3, to operate the dispenser device 10, a user may press the trigger 12 in the direction A whereupon the rocker 22 turns in the direction C to engage in direct abutment an end of the sleeve 16. The sleeve 16 then slides linearly longitudinally in the rearward direction toward the coupler 34. The flow valve 20 is consequently moved to its open position and water then rushes through the primary passage 78 of the eductor 18. Simultaneously, the gasket 56 slides with the sleeve 16 to bring the inlet passage 58 in axial alignment with the inlet bore 44 of the plate 42. Once circumferentially and axially aligned, cleaning solution concentrate is drawn through the inlet bore 44, through the inlet passage 58, through the first passage 80 (could be the second passage 82), through the first orifice plate 84, and into the primary passage 78. At the intersection of the first passage 80 and the primary passage 78, the cleaning solution concentrate mixes with the rushing water to produce the diluted mixture.

To what extent the flow valve 20 opens may be determined in part by the cutouts 64, 66, 68. The cutouts 64, 66, 68 may limit the linear longitudinal sliding distance of the sleeve 16, which in turn may limit the opening degree of the flow valve 20 and thus dictate the resulting volumetric flow rate of the diluent. The pin 88 may block and prevent the sleeve 16 from moving beyond the longitudinal length of a respective cutout 64, 66, 68 by direct abutment between the pin and the peripheral wall of the respective cutout. The cutouts 64, 66, 68 may also be used to index the first and second passages 80, 82 of the eductor 18 for respective circumferential alignment with the inlet passage 58 of the gasket 56, as will be subsequently described.

The dispenser device 10 may have a first, or low, diluted mixture flow mode (hereafter "low flow mode") to fill, for example, a bottle, and may have a second, or high, diluted mixture flow mode (hereafter "high flow mode") to fill, for example, a bucket. In one embodiment, both the low and high flow modes may produce a diluted mixture with the same or substantially the same weight or volume ratio of diluent-to-chemical concentrate—for example, 60:1. The exact ratio of diluent-to-chemical concentrate may be based in part on the size and dimension of the orifice plates and the longitudinal lengths of the cutouts. Of course, in other embodiments, the low and high flow modes may produce diluted mixtures with different weight or volume ratios of diluent-to-chemical concentrate; for example, the high flow mode may produce a more concentrated diluted mixture, while the low flow mode may produce a less concentrated diluted mixture. And in one embodiment, the low flow mode may expel a diluted mixture at about 1.0 to 1.5 gpm, and the high flow mode may expel a diluted mixture at about 3.5 to 4.0 gpm Referring to FIGS. 4 and 5, when the user desires to set the dispenser device 10 in the low flow mode, the user may rotate the collar 40 to a first position where the pin 88 may move into the first cutout 64; the pin may be rotated against a confronting peripheral sidewall of the first cutout. The eductor 18 may rotate with the collar 40 via its fixed connection therewith by the pin 88. This may bring the first passage 80 of the eductor 18 in circumferential alignment with the inlet passage 58 of the gasket 56, thereby indexing the passage of the eductor with that of the gasket by way of the cutout and pin interaction. The circumferential alignment may include a relationship where the first passage 80 is located at a similar or the same circumferential or angular position as the inlet passage 58 with respect to an imaginary cylinder defined generally by the shape of the eductor; this does not necessarily mean, though could mean, that the first passage and the inlet passage are also located at a similar or the same axial position of the imaginary cylinder, and does not necessarily mean, though could mean, that the first passage and the inlet passage are in communication with each. The first cutout 64 may have a longitudinal length dimension which corresponds to an opening degree of the flow valve 20 resulting in a relatively low volumetric flow rate of diluent. The sleeve 16 may therefore only slide a linear distance equal to the longitudinal length of the first cutout 64. Similarly, the first orifice plate 84 (if indeed provided in the first passage 80) may permit the first predetermined volumetric flow rate of chemical concentrate therethrough which may constitute a relatively low volumetric flow rate of chemical concentrate. Together, the low volumetric flow rates of diluent and chemical concentrate may produce the predetermined ratio of diluent-to-chemical concentrate. After rotating the collar 40, the user may then press the trigger 12 to slide the sleeve 16 and initiate fluid-flow.

Setting the dispenser device 10 in the high flow mode may be in some ways similar to setting it in the low flow mode. This time the user may rotate the collar 40 to a second position where the pin 88 may be located in the third cutout 68; the pin may be rotated against a confronting peripheral sidewall of the third cutout. The eductor 18 may rotate with the collar 40. This may bring the second passage 82 in circumferential alignment with the inlet passage 58 of the gasket 56. The third cutout 68 may have a longitudinal length dimension which corresponds to an opening degree of the flow valve 20 resulting in a relatively high volumetric flow rate of diluent. Similarly, the second orifice plate (if indeed provided in the second passage 82) may permit the second predetermined volumetric flow rate of chemical concentrate therethrough which may constitute a relatively high volumetric flow rate of chemical concentrate. Together, the high volumetric flow rates of diluent and chemical concentrate may produce the predetermined ratio of diluent-to-chemical concentrate.

The dispenser device 10 may also have a third, or locked, diluted mixture flow mode (hereafter "locked flow mode") in order to check and preclude movement of the trigger 12 and thus prevent fluid-flow in the dispenser device. To set the dispenser device 10 in this mode, the operator may rotate the collar 40 to a third position where the pin 88 may be located in the second cutout 66 (shown set in the locked flow mode in FIG. 5). Here, neither the first passage 80 nor the second passage 82 are circumferentially aligned with the inlet passage 58 of the gasket 56, and instead an unpassaged portion of the eductor 18 confronts the inlet passage. The second cutout 66 may not have a longitudinal length dimension which allows any appreciable sliding of the sleeve 16. Consequently, there is no chemical concentrate fluid-flow and no diluent fluid-flow.

In other illustrative embodiments of FIGS. 9-29, a dispenser and container assembly 100 may include a container 102 and a dispenser device 104. The container 102 may be used to hold the chemical or cleaning solution concentrate, and may be equipped with the dispenser device 104 in order to provide the cleaning solution concentrate to the dispenser device. The cleaning solution concentrate may comprise a disinfectant, a deodorizer, a glass cleaner, a detergent, a hydrogen-peroxide-based cleaner, a bio-based cleaner, a sanitizer, a degreaser, a carpet cleaner, an acid bathroom and shower cleaner, a combination thereof, or another chemical. The container 102 may be comprised of a material that is chemically compatible with the cleaning solution concentrate with which it holds. The container 102 may have different sizes to hold different volumes of cleaning solution concentrate; for example, the container may be sized to hold 1.5 liters of concentrate, 4.0 liters of concentrate, or another volume. The container 102 may be designed and constructed to accommodate a 3-5% overfill volume in addition to its sized volume.

Figure 9:
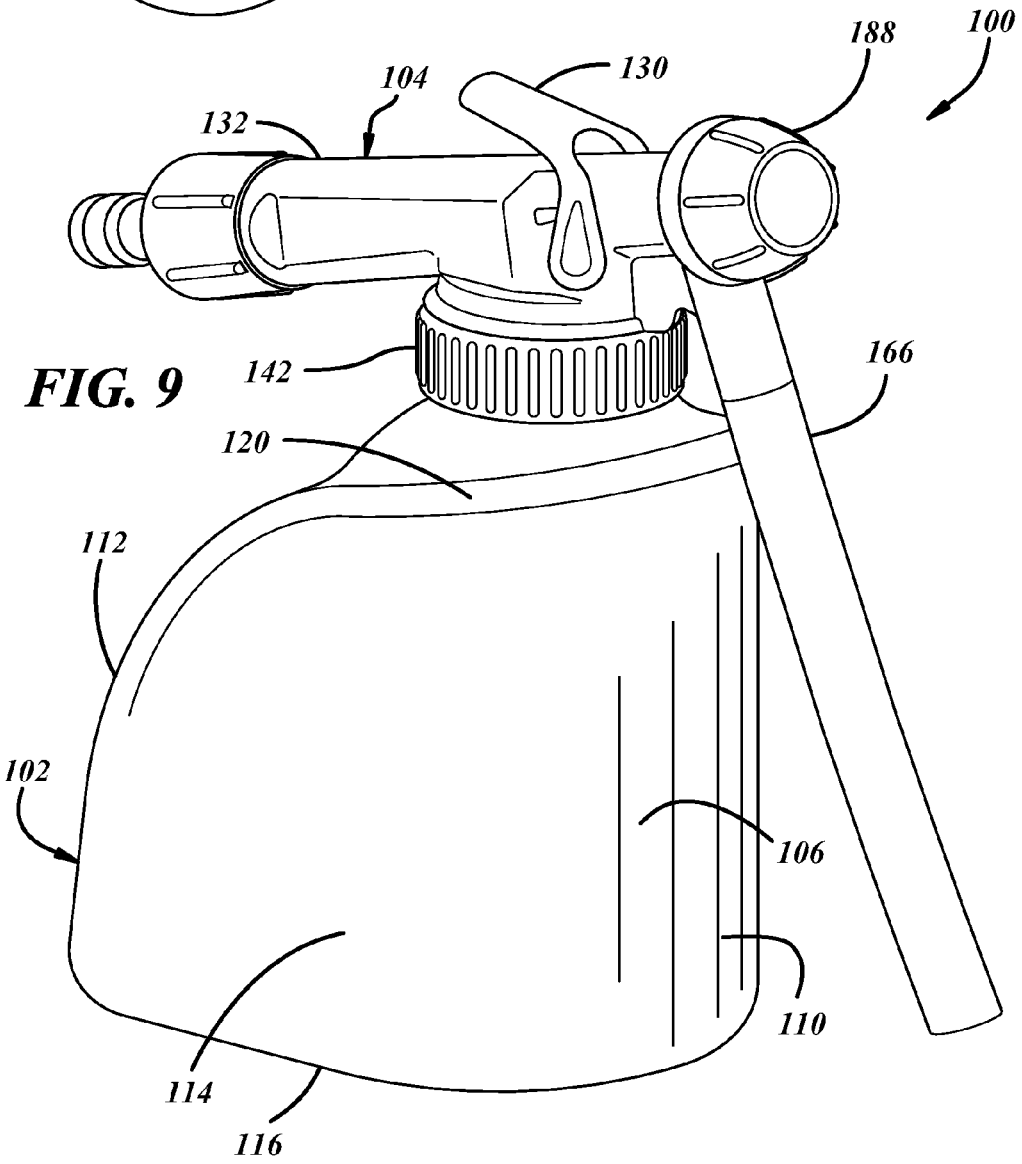
FIG. 9 is a perspective view of an illustrative embodiment of a dispenser and container assembly.
Figure 10:
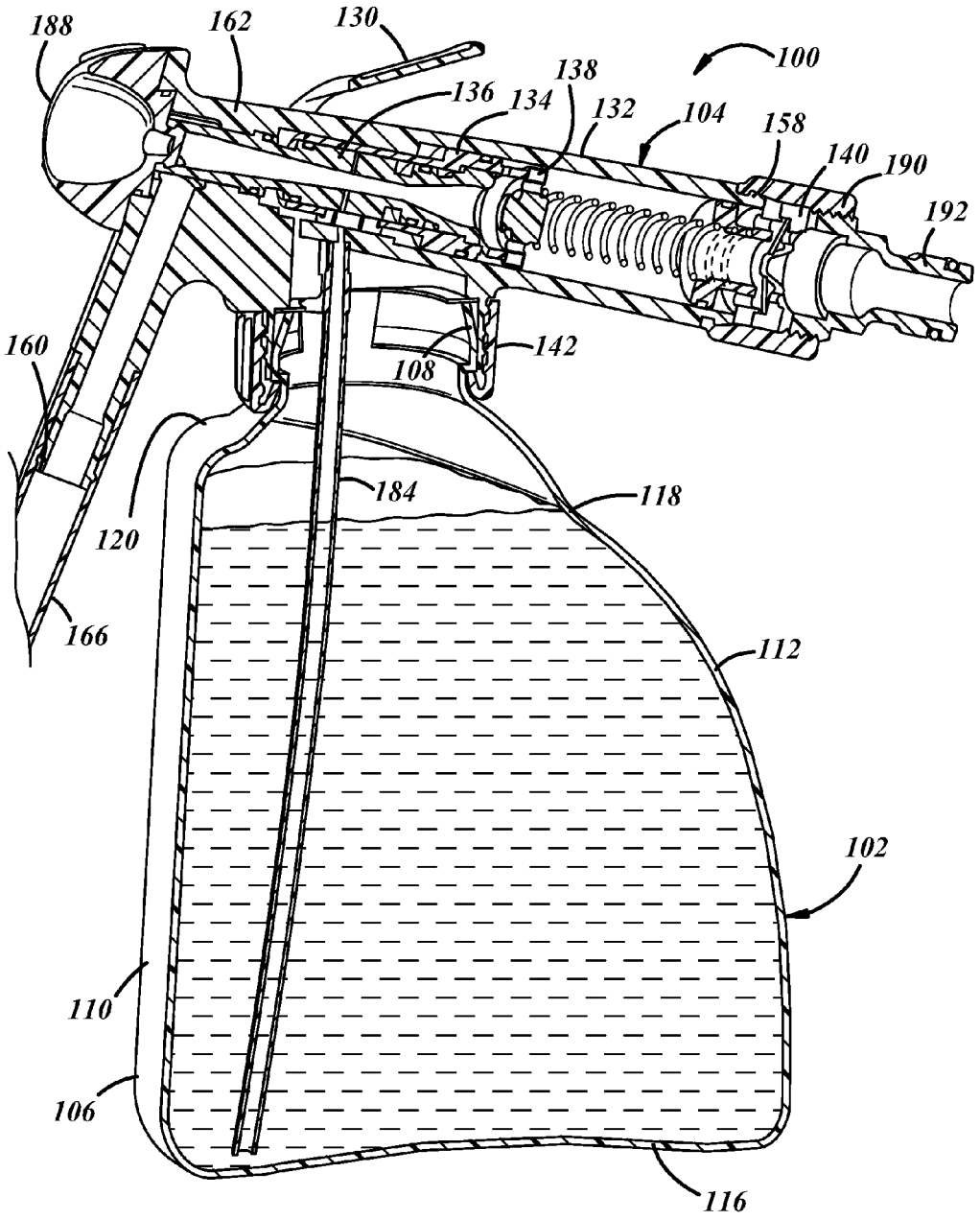
FIG. 10 is a cross-sectional view of the dispenser and container assembly of FIG. 9.
Figure 11:
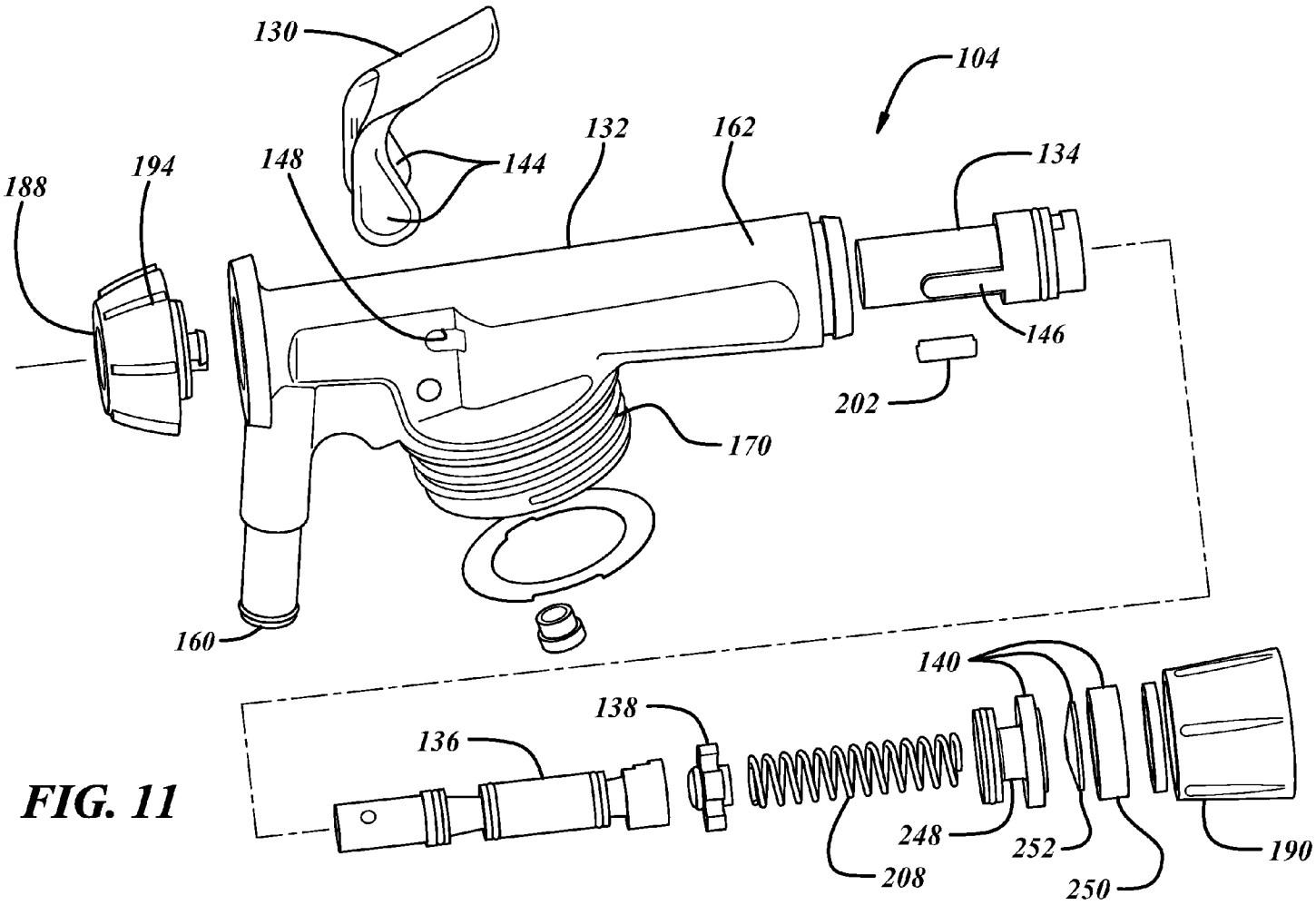
FIG. 11 is an exploded view of the dispenser device of FIG. 9.
Figure 24:
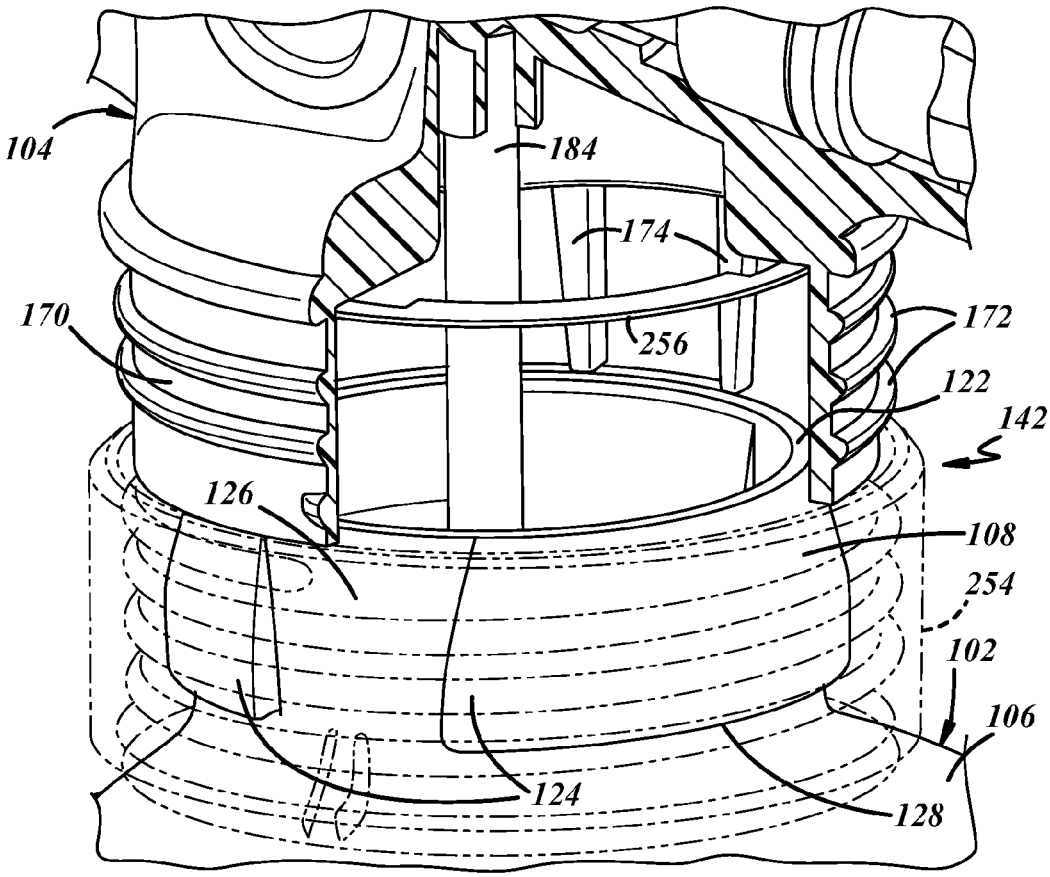
FIG. 24 is an enlarged cross-sectional view of the connector assembly of FIG. 23.
Figure 28:
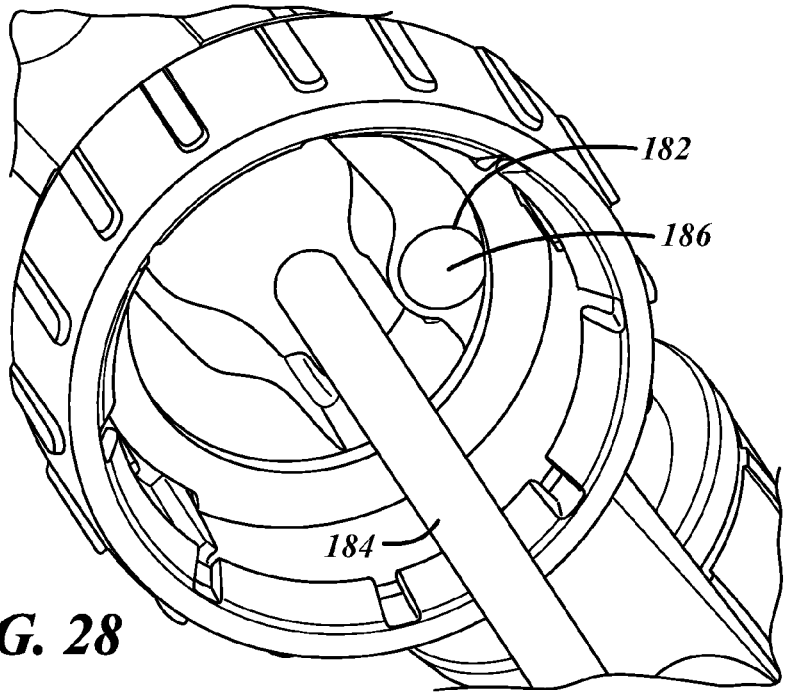
FIG. 28 is an enlarged view of an illustrative vent bore.

Referring to FIGS. 9, 10, and 24, in the illustrated embodiment the container 102 may have a body 106 and a neck 108. The body 106 may have a rounded, half-cylindrical front wall 110, an outwardly curved back wall 112, a pair of generally planar side walls 114 extending between the front and back walls, and a closed bottom 116. The back wall 112 may have an indentation 118 that marks the correct and predetermined volume fill level. The body 106 may also have a shoulder 120 located around the neck 108. The neck 108 may have an open end 122 and may have multiple bulges 124 spaced circumferentially around its wall. Each bulge 124 may have a bottom edge 128. Between the bulges 124, non-bulged portions of the neck's wall may form multiple pockets 126. The neck 108 may be constructed and arranged to have various dimensions. In one example, the open end 122 may comply with a 38 mm minimum Society of Plastics Industry (SPI) standard 400H neck finish; of course, in other examples, other dimensions and compliances are possible.

The dispenser device 104 may be assembled to the container 102 and may draw cleaning solution concentrate out of the container to mix with flowing water in the dispenser device. In the illustrated embodiment, the dispenser device 104 may include a trigger 130, a housing 132, a sleeve 134, an eductor 136, a flow valve 138, a backflow valve 140, and a connector assembly 142.

The trigger 130 may be pressed in order to initiate actuation of the dispenser device 104, which may then let in pressurized water from a hose (not shown) and may allow cleaning solution concentrate to be drawn into the dispenser device from the container 102. The trigger 130 may have various designs and constructions, including that shown in FIGS. 11-14. In the illustrated embodiment, the trigger 130 may have a pair of legs 144 extending down from each side of the trigger. Each of the pair of legs 144 may have an inwardly projecting button or pin that may be complementary to and may be received in an indentation or hole in the housing 132. In this example, the trigger 130 may be connected to the housing 132 via a pin-hole connection, whereby the trigger is press-fit and straddled over the housing and the pins are received in the respective holes in sides of the housing. In operation, the user presses the trigger 130 down in a direction A whereupon the trigger may pivot about a pivot point B defined at the pin-hole connection. A side of each leg 144, or another structure of the leg, may then engage a nub 146 of the sleeve 134, which may cause the sleeve to move linearly inside the housing 132. The nubs 146 may have exposed free ends protruding outside of the housing 132 and on opposite sides of the housing through respective openings 148 in the walls of the housing.

Figure 13:
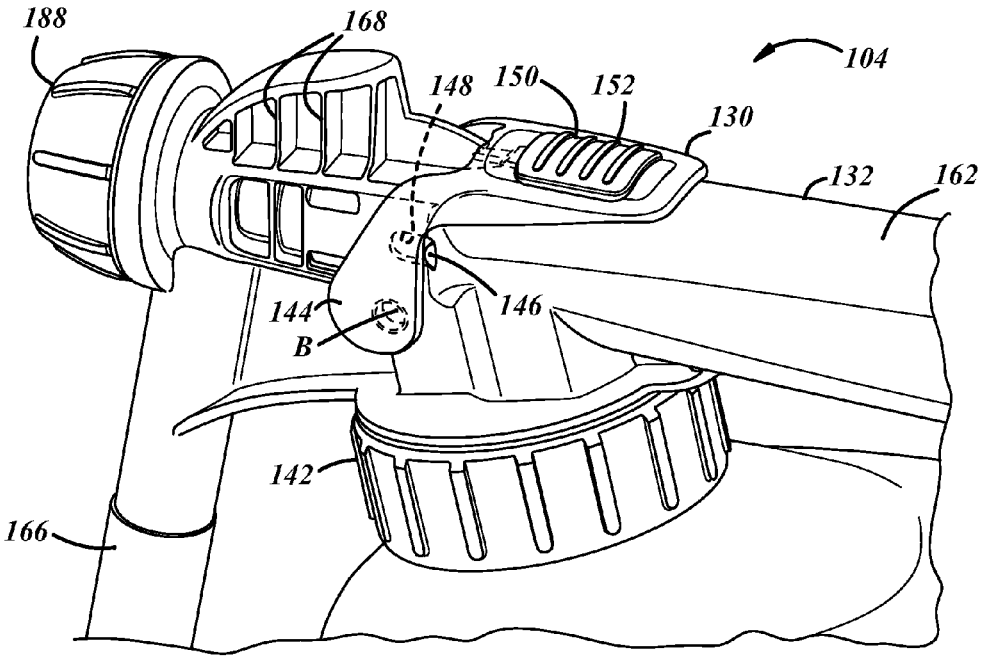
FIG. 13 is an enlarged view of the dispenser device of FIG. 12.
Figure 14:
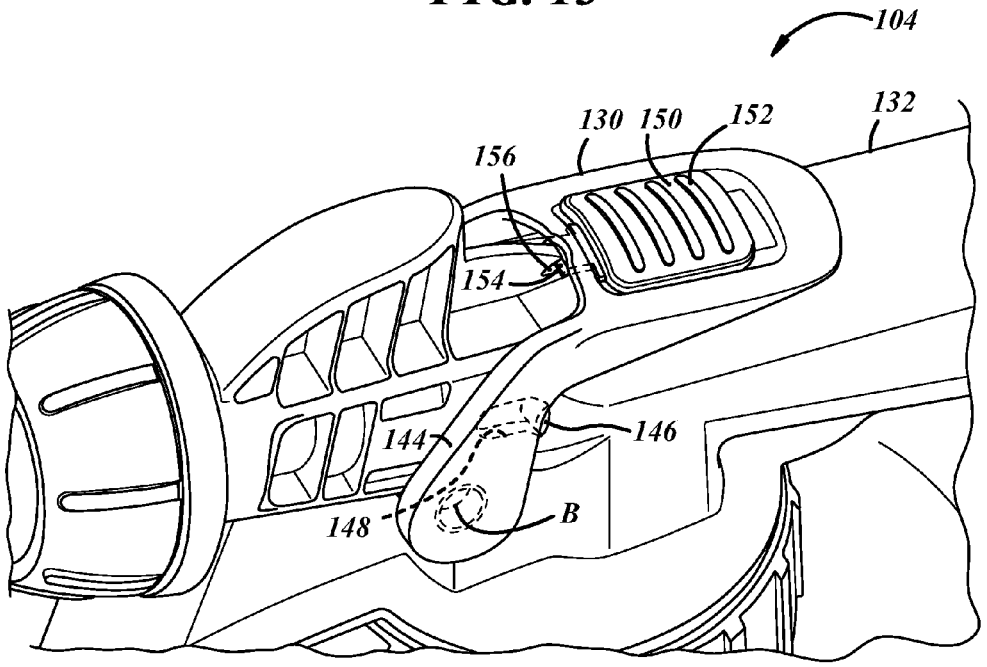
FIG. 14 is an enlarged view of an illustrative trigger of the dispenser device of FIG. 12.

The trigger 130 may further include a manual lock 150 that may be used to keep the trigger in the fully actuated position if so desired (actuated position shown in FIGS. 13 and 14). The lock 150 may have a ribbed outer surface 152 for gripping by the users, and may have a forwardly projecting finger 154. To fasten the lock 150, the lock may be slid forward and the finger 154 may then be caught in a notch or cleft 156 located in the housing 132.

The housing 132 may surround the sleeve 134, the eductor 136, the flow valve 138, and the backflow valve 140, and may support the structures thereof. The housing 132 may also facilitate connection to a diluent source, such as connection to a water hose. The housing 132 may have various designs and constructions, including that shown in FIGS. 10, 11, 13, 15, and 24. In the illustrated embodiment, the housing 132 may have an inlet 158 that initially receives diluent, and may have an outlet 160 that discharges the diluted mixture. The housing 132 may have a one-piece main body 162 with a bore 164 having a generally cylindrical shape; in other embodiments, the housing may be constructed of numerous separate and distinct pieces that are subsequently assembled together. The bore 164 may have portions of different dimensions (e.g., different diameters) to accommodate receipt of the sleeve 134, the eductor 136, the flow valve 138, and the backflow valve 140.

Figure 15:
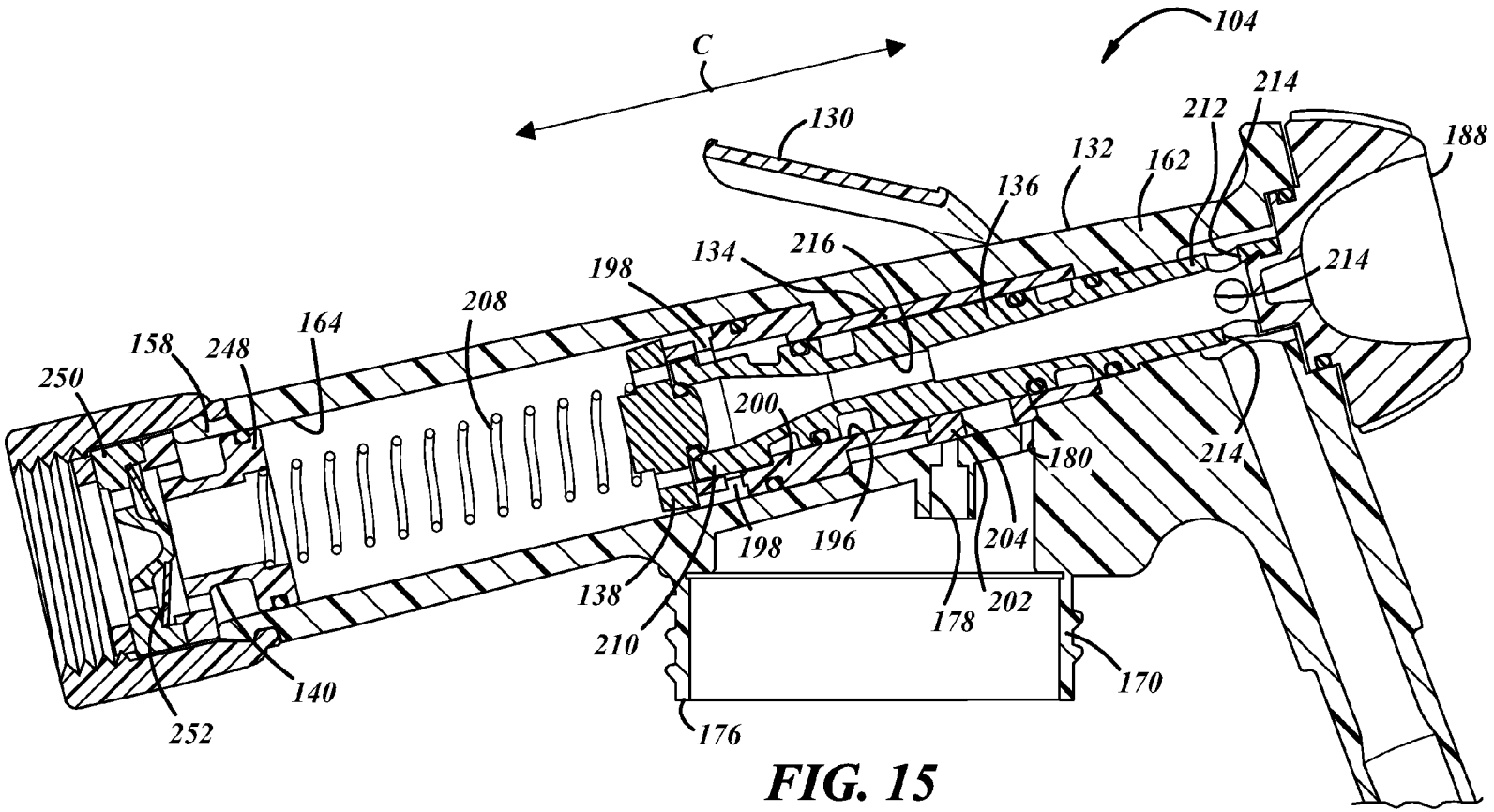
FIG. 15 is a cross-sectional view of the dispenser device of FIG. 9, showing the dispenser device set in a locked flow mode.

The housing 132 may also have an outlet tube or spout 166, structural ribs 168, and a neck 170. The outlet tube 166 may be a separate attachment, or may be unitary with the housing 132. FIG. 13 shows an illustrative embodiment of the housing 132 with structural ribs 168, and FIG. 15 shows an illustrative embodiment of the housing 132 without the same structural ribs. The structural ribs 168 may be used to strengthen the housing 132, which may be desirable in some circumstances such as during shipping and use. Though not shown, the structural ribs 168 may be located elsewhere on the housing 132. The neck 170 may be used to connect the dispenser device 104 to the container 102, and may be a part of the connector assembly 142. In assembly, the neck 170 may be telescopically mated with the neck 108 of the container 102. Referring in particular to FIG. 24, the neck 170 may have external threads 172 and internal guide ribs 174. When the dispenser device 104 and the container 102 are brought together in assembly, the neck 170 is piloted with the neck 108 via the guide ribs 174 which interengage with and are inserted in the pockets 126 of the container. In this way, the dispenser device 104 and the container 102 may be properly angularly orientated with respect to each other. The neck 170 may have an open end 176 and a closed end opposite the open end.

Referring now to FIGS. 26-29, the housing 132 may further have an inlet bore 178, a first or primary vent bore 180, and a second or secondary vent bore 182. The inlet bore 178 may receive cleaning solution concentrate from the container 102, and may communicate the cleaning solution concentrate through the housing 132 and to the eductor 136. The inlet bore 178 may be connected to an inlet tube 184 which may extend to the closed bottom 116 of the container 102 in order to draw cleaning solution concentrate thereat. The first vent bore 180 may be used to relieve partial vacuum build-up in the container 102 which may develop during use of the assembly 100, such as during drawing of the cleaning solution concentrate. The first vent bore 180 may have or may communicate with one or more passages that are routed through the body 162 of the housing 132, and that eventually lead to the exterior of the body or to the atmosphere at an opening 185. The opening 185 may exit the housing 132 adjacent one of the legs 144 of the trigger 130 (trigger shown removed in FIG. 27). The leg 144 may cover the opening 185 when the trigger 130 is in its unactuated state, and may uncover and expose the opening when the leg moves as the trigger is actuated. The second vent bore 182 may be provided in the housing 132 when the cleaning solution concentrate comprises a solution that can accumulate gas in the container 102, such as hydrogen peroxide. Like the first vent bore 180, the second vent bore 182 may have and may communicate with one or more passages that are routed through the body 162 and that eventually lead to the exterior of the body or to the atmosphere at an exit opening 187. The second vent bore 182 may include a membrane member 186 that may be press-fit therein at an entrance opening and that may serve as a selective barrier in the second vent bore. The membrane member 186 may be impermeable to one substance or chemical, while being permeable to another substance or chemical. One example of a membrane member 186 may be available from W.L. Gore & Associates, Inc. of Newark, Del., U.S.A. (www.gore-.com).

Referring again to FIGS. 10 and 11, the housing 132 may include components that are separate and distinct from the body 162 such as a control knob 188, a connector 190, and a coupler 192. Though shown and described as separate, in other embodiments these components may be a unitary portion of the body of the housing. The control knob 188 may be rotated by the user in order to set the dispenser device 104 in a desired mode, and may have indicia visible to the user that mark the particular mode. The control knob 188 may have a ribbed outer surface 194 for gripping by the user, and may have a fixed connection to the eductor 136 so that the eductor rotates concurrently with the control knob. The connector 190 and the coupler 192 may be used to facilitate connection to the diluent source. Their design and construction may be dictated in part by, among other factors, the diluent source design and construction. In the illustrated embodiment, the connector 190 may have internal threads and the coupler 192 may have external threads mated therewith. The coupler 192 may have one or more o-rings for a sealed connection with the diluent source, and may be designed for a quick-connect type of connection.

The sleeve 134 may slide linearly back-and-forth in a direction C as shown in FIG. 15 (i.e., along an imaginary longitudinal axis of the sleeve) upon actuation, and may cause the flow valve 138 to open and close. The sleeve 134 may have various designs and constructions, including that shown in FIGS. 11, 15, and 20. In the illustrated embodiment, the sleeve 134 may have a generally cylindrical shape with a bore 196 of different dimensions along its longitudinal extent (e.g., different diameters) in order to accommodate receipt of the eductor 136. The sleeve 134 may circumferentially surround a portion or more of the eductor 136 in a telescopic and concentric relationship with the portion or more of the eductor located within the interior of the sleeve, while a number of gaskets, such as o-rings, and bearings may be located between the sleeve and the eductor to facilitate sealing and frictionless movement therebetween. Likewise, a number of gaskets, such as o-rings, and bearings may be located between the sleeve 134 and the housing 132 to facilitate sealing and frictionless movement therebetween.

At one end, the sleeve 134 may directly abut the flow valve 138 and may maintain direct contact therewith throughout opening and closing movements of the flow valve. Near the end, the sleeve 134 may have passages 198 for diluent flow when opened in a particular mode of the dispenser device 104. The passages 198 may be located in and may extend completely through the wall of the sleeve 134. The passages 198 may be located axially forward of the terminal end of the sleeve 134 adjacent the flow valve 138. Apart from the passage 198, in the illustrated embodiment, diluent may not flow through any substantial portion of the sleeve 134. Inside the bore 196, the sleeve 134 may have a step 200 that may interact with a complementary structure of the eductor 136 during actuation of the dispenser device 104, as will be subsequently described. The step 200 may be an inner ledge or projection that may be located in the bore 196 and that may extend radially inwardly therefrom. The step 200 may have an abutment edge 201 (FIG. 20) which is rearwardly-facing and directly confronts a complementary abutment edge of the eductor 136. The sleeve 134 may include a gasket 202 that may be used to block and unblock the inlet bore 178 and the first vent bore 180 of the housing 132 during actuation of the dispense device 104. The gasket 202 may have a single passage 204, and may have an unpassaged portion that may at least partly define the passage. The gasket 202 may be seated and trapped in a recess provided in the wall of the sleeve 134, and may slide linearly back-and-forth concurrently with the sleeve.

Figure 12:
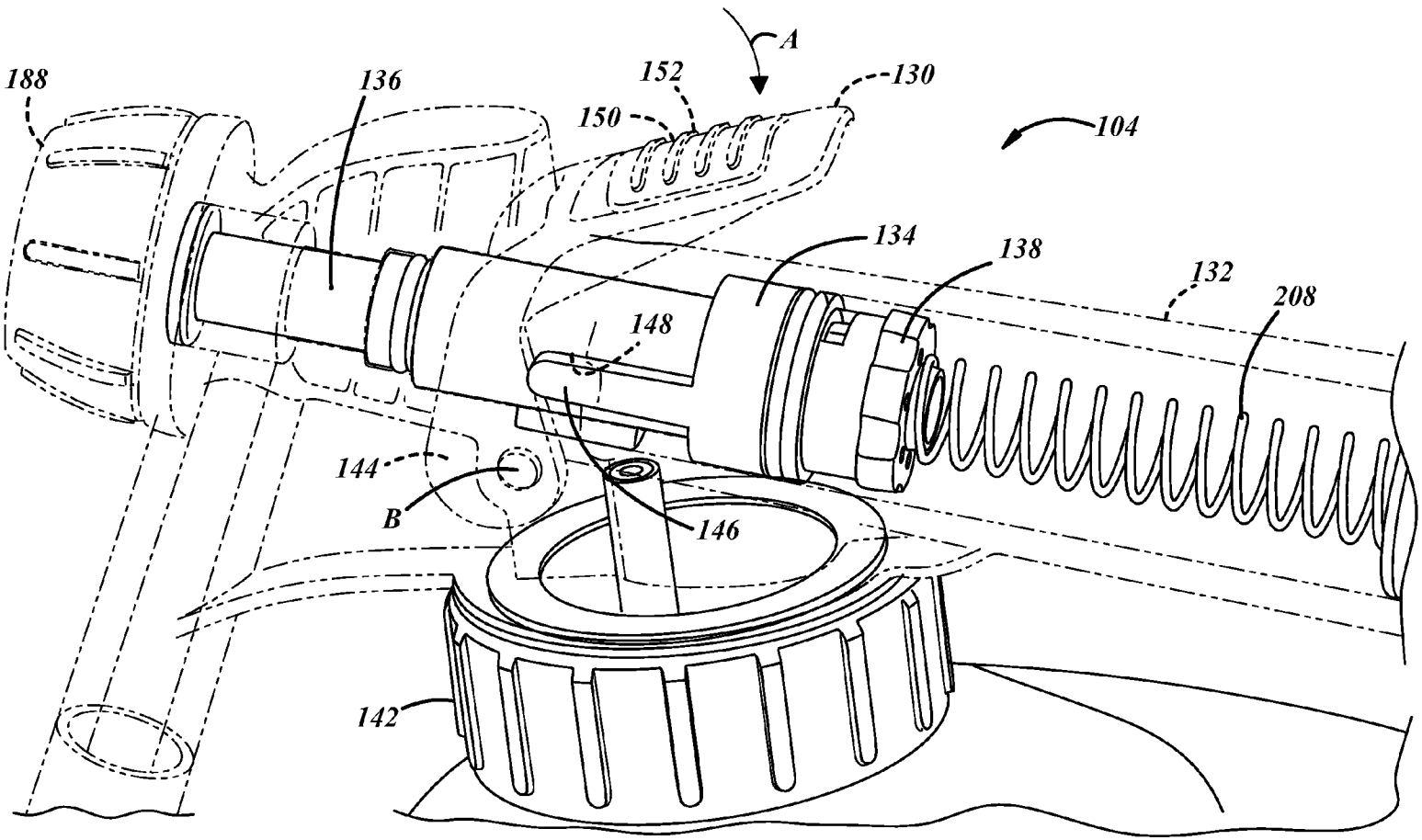
FIG. 12 is an enlarged view of an illustrative embodiment of a dispenser device, with external components shown in phantom in order to show internal components of the dispenser device.
Figure 19:
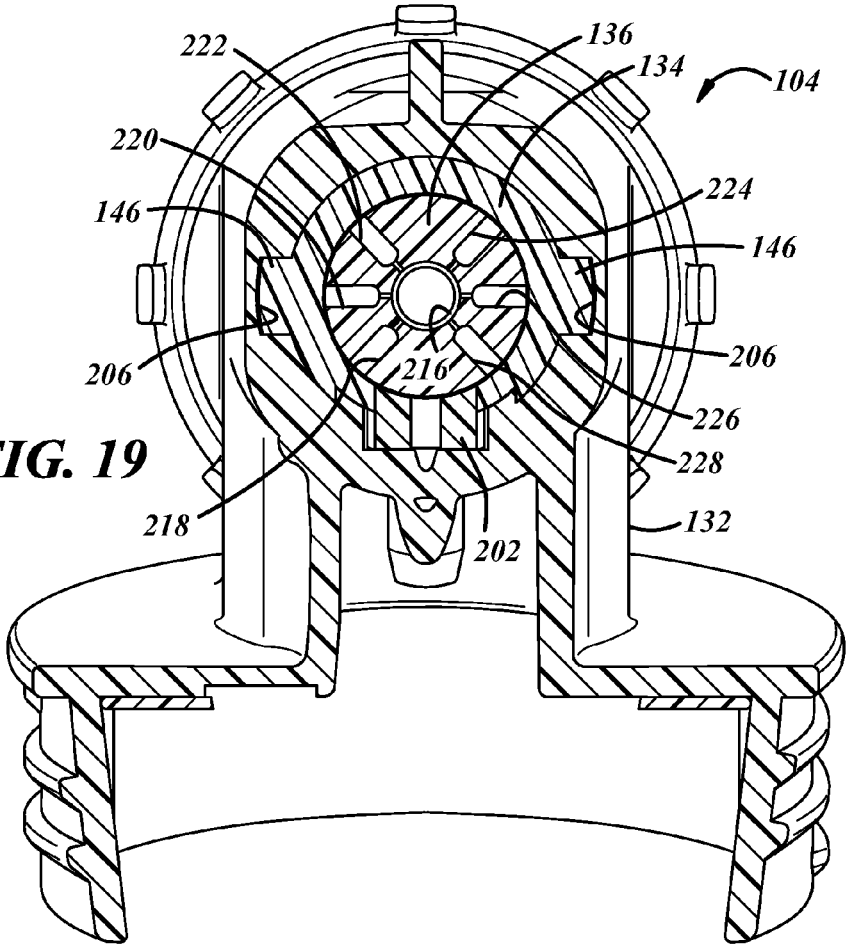
FIG. 19 is a cross-sectional view of an illustrative eductor of the dispenser device of FIG. 12.
Figure 27:
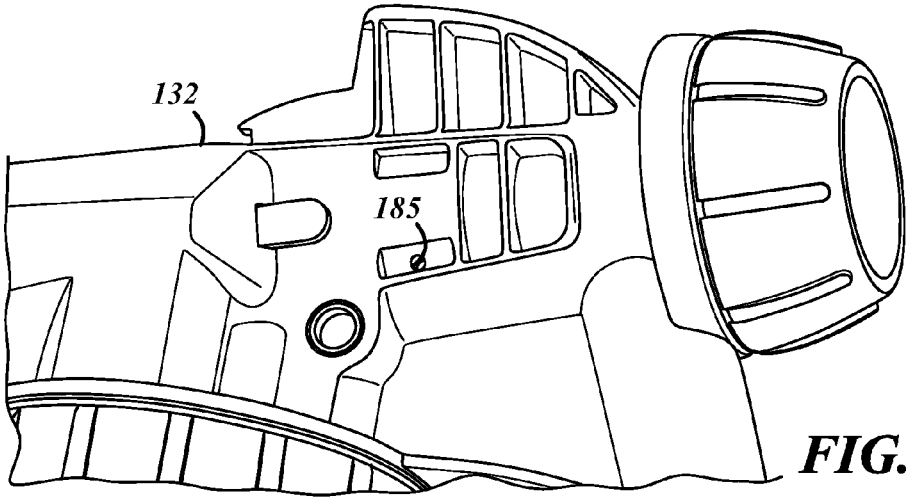
FIG. 27 is another view of the vent bore of FIG. 26A.

In use, the sleeve 134 may slide linearly longitudinally and back-and-forth in the direction C, and may move independently of the eductor 136. The sleeve 134 may not rotate during use. Referring to FIGS. 12 and 19, rotation may be prevented by way of interengaging nubs 146 of the sleeve 134 and the opening 148 of the housing 132, and by way of interengaging nubs 146 and recesses 206 of the housing. The interengaging structures may permit longitudinal reciprocation of the sleeve 134 with respect to the housing 132, and may check and prevent rotational movement between the sleeve and the housing. At rest and unactuated, the sleeve 134 may be biased in a forward-most position (FIG. 15) via a spring 208 where the flow valve 138 is in a closed position. The spring 208 may extend between the backflow valve 140 and the flow valve 138. The sleeve may have other embodiments that are not shown in the figures; for example, the sleeve need not fully circumferentially surround the eductor whereby only a portion of the sleeve would surround the eductor, and the sleeve need not make and maintain direct abutment with the valve and instead could cause valve movement via an intermediate structure.

The eductor 136 may direct incoming diluent flow and incoming cleaning solution concentrate flow to an intersection where the fluids may mix with each other and produce a diluted mixture. The eductor 136 may have various designs and constructions, including that shown in FIGS. 11, 15, 19, and 20. In the illustrated embodiment, the eductor 136 may have a generally cylindrical shape and may be telescoped partially within the sleeve 134. The cylindrical shape may have portions of different dimensions (e.g., different diameters), and may have outer circumferential grooves for seating o-rings. The eductor 136 may have an inlet end 210 with a generally narrowing-cone shape in the forward fluid-flow direction for receiving diluent when the flow valve 138 is opened, and may have a discharge end 212 with a generally and gradually widening cone-shape in the forward fluid-flow direction for discharging the resulting diluted mixture. The discharge end 212 may have passages 214 which may communicate with the outlet tube 166 and which may direct the resulting diluted mixture into the outlet tube.

Near the discharge end 212, the eductor 136 may have a fixed connection with the control knob 188 via, for example, interlocking structures so that the eductor may rotate about its longitudinal axis concurrently with the control knob and may not slide linearly longitudinally. In different examples, a terminal end of the control knob 188 may be inserted and press-fit into the eductor 136, or may be snap-fit into the eductor. The eductor 136 may have a primary passage 216 extending axially between the inlet end 210 and the discharge end 212. Shown best in FIG. 19, the eductor 136 may further have a first passage 218, a second passage 220, a third passage 222, a fourth passage 224, a fifth passage 226, and a sixth passage 228. These passages may be radially extending, and may each intersect and communicate with the primary passage 216. In this illustrative embodiment, the passages 218, 220, 222, 224, 226, 228 may extend between the passage 204 and the primary passage 216 in a single direction and without any substantial turns or misdirections. The passages 218, 220, 222, 224, 226, 228 may have different dimensions (e.g., diameters) with respect to one another, and may have different dimensions (e.g., diameters) with respect to the primary passage 216. Depending upon their dimensions, the passages may permit different predetermined volumetric flow rates of cleaning solution concentrate therethrough. The passages 218, 220, 222, 224, 226, 228 may be circumferentially offset with respect to one another and thus may be at different angular locations.

Figure 20:
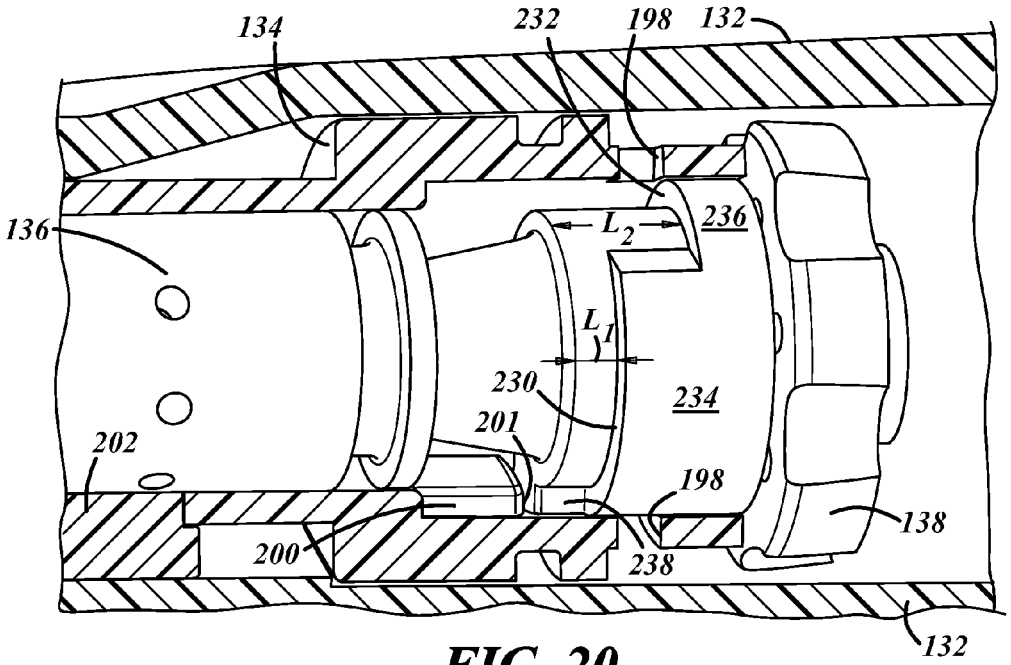
FIG. 20 is an enlarged cross-sectional view of the dispenser device of FIG. 12.

Referring particularly to FIG. 20, the eductor 136 may have an indexing feature such as a first groove 230 and a second groove 232 that may interact with the step 200 of the sleeve 134 during actuation of the dispenser device 104. In other embodiments, the indexing feature may be provided on the sleeve whereby the sleeve would have the first and second grooves and the eductor would have the step; this may also be an embodiment of the sleeve 16 and eductor 18 already described. The first and second grooves 230, 232 may be formed in part by raised and unraised portions in the radial direction of the eductor 136 that are located on the exterior thereof, such that the first groove 230 may be located adjacent a first step 234 (radially-outwardly raised portion) and the second groove 232 may be located adjacent a second step 236 (radially-outwardly raised portion). Furthermore, a third step 238 may also be located on the exterior of the eductor 136. The first, second, and third steps 234, 236, and 238 may be located circumferentially offset with respect to one another and with reference to the generally cylindrically-shaped eductor 136. The first, second, and third steps 234, 236, 238 may each have an abutment edge which are forwardly-facing. The first and second grooves 230, 232 may each have a longitudinal length ($L_1$ and $L_2$ respectively, as shown in FIG. 20) measured in a direction parallel to the longitudinal axis of the eductor 136 from the step 200 when the sleeve 134 is unactuated, and to the respective step 234, 236. The first groove 230 may have a first longitudinal length $L_1$ and the second groove 232 may have a second longitudinal length $L_2$. The second longitudinal length $L_2$ may have a value that is greater than a value of the first longitudinal length $L_1$. The third step 238, in contrast, may not form an appreciable longitudinal length with the step 200.

The flow valve 138 may regulate diluent flow into the primary passage 216 of the eductor 136 at the inlet end 210. The flow valve 138 may have various designs and constructions including that shown in FIGS. 11, 15, and 22. In the illustrated embodiment, the flow valve 138 may be located at an inlet opening 239 of the eductor 136, and may open and close the inlet opening in order to permit and prevent diluent fluid-flow therethrough; the flow valve may permit diluent fluid-flow in varying degrees of flow volume between its open and closed states. The flow valve 138 may have a plug portion 240 and an o-ring 242 therearound, which may be inserted into the primary passage 216 at the inlet opening 239 of the eductor 136 when the flow valve is closed and sealed. When opened, diluent may flow through inner passages 244 of the flow valve 138, outer recesses 246 of the flow valve, or both, and passed the plug portion 240. The inner passages 244 may be located within the interior portion of the flow valve 138 and may extend axially completely through the flow valve, and the outer recesses 246 may be half-cylindrical indents around the outer periphery of the flow valve and may extend axially completely through the flow valve. When the sleeve 134 is unactuated, the flow valve 138 may be biased in a forward-most and closed position (FIG. 15) via the spring 208, may be biased in the closed position via pressurized diluent flow, or both. In use, the flow valve 138 may slide linearly back-and-forth concurrently with the sleeve 134, which may cause the flow valve to open and close.

The backflow valve 140 may regulate diluent flow into the housing 132 near the inlet 158. The backflow valve 140 may have various designs and constructions including that shown in FIGS. 11 and 15. In the illustrated embodiment, the backflow valve 140 may be located near the inlet 158. The backflow valve 140 may act as a one-way valve, and may permit diluent flow entering through the inlet 158 into the bore 164, and may prevent fluid-flow in the opposite direction exiting out the inlet and out the bore. The backflow valve 140 may include a valve body 248, a port body 250, and a valve member 252. The valve body 248 may be fixed in the bore 164, and may serve as a stationary component against which the spring 208 may depend. The valve member 252 may be seated against the port body 250. The valve member 252 may be a flapper that may be flexed and biased in its closed position. Pressurized diluent flow may force and flex the valve member 252 to its open position.

Figure 23:
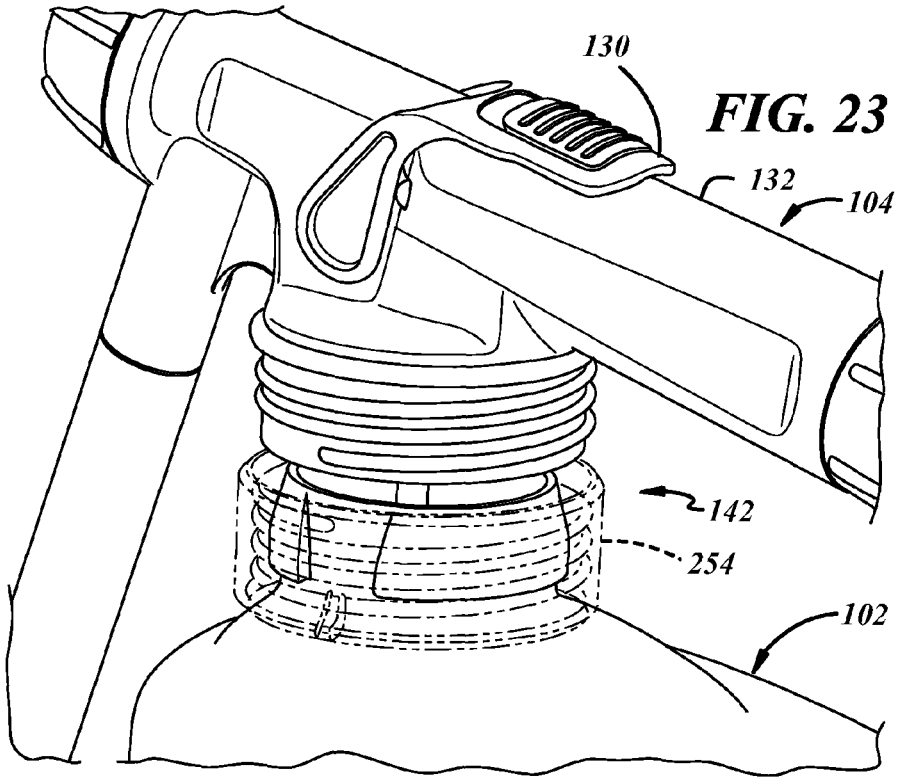
FIG. 23 is an enlarged view of an illustrative connector assembly of the dispenser device of FIG. 9.
Figure 25:
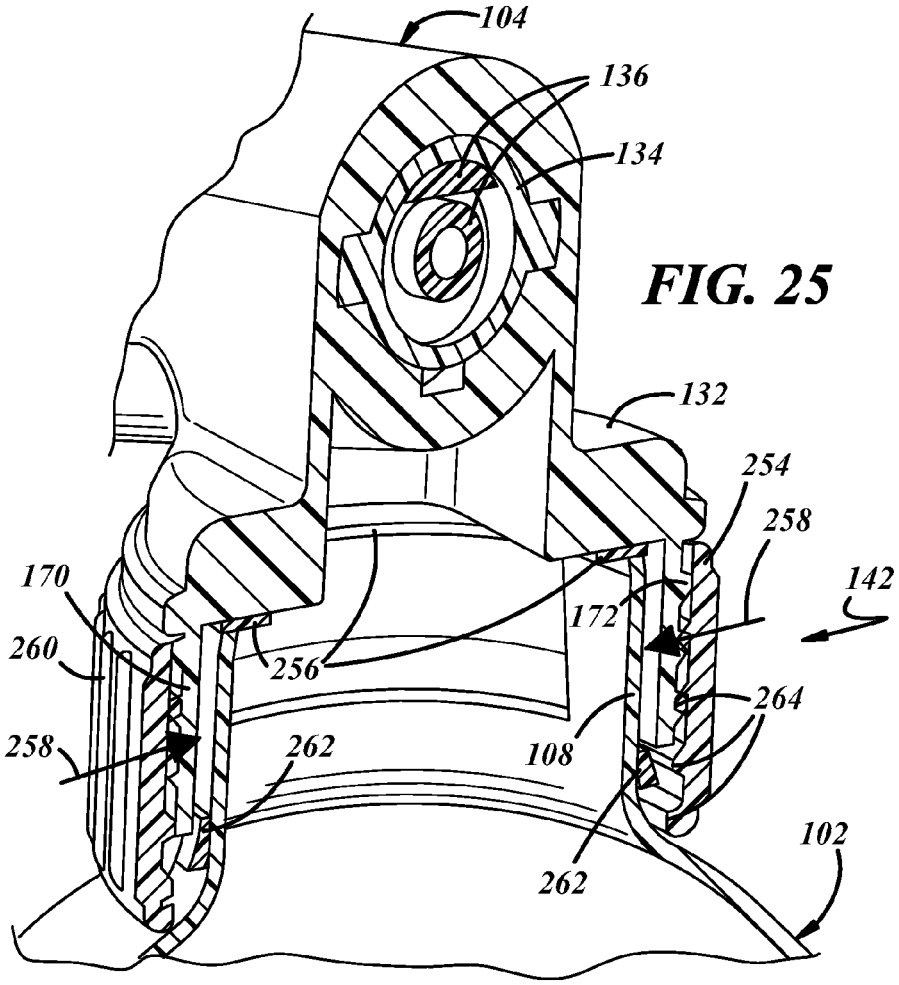
FIG. 25 is a cross-sectional view of the connector assembly of FIG. 23 and of other components of the dispenser device.
Figure 29:
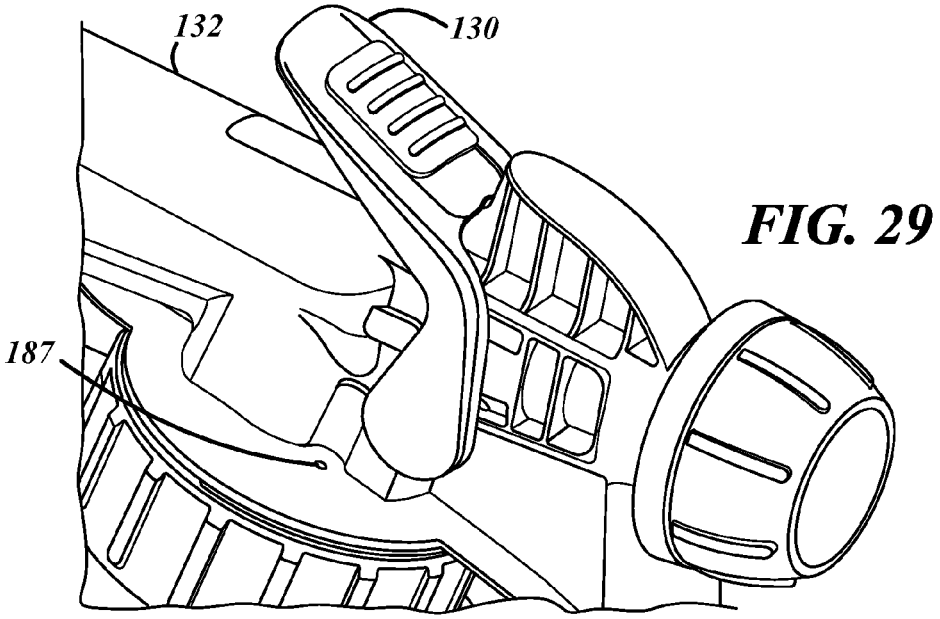
FIG. 29 is another view of the vent bore of FIG. 28.
Figure 26A:
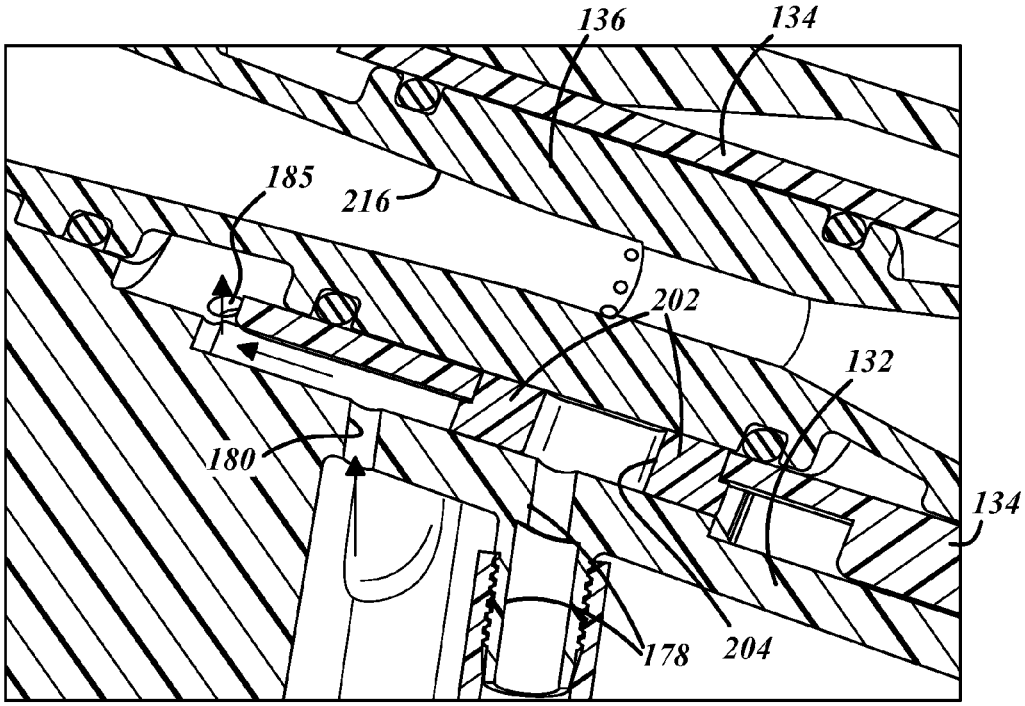
FIG. 26A is an enlarged cross-sectional view of an illustrative vent bore and an illustrative inlet bore, shown in an open state.
Figure 26B:
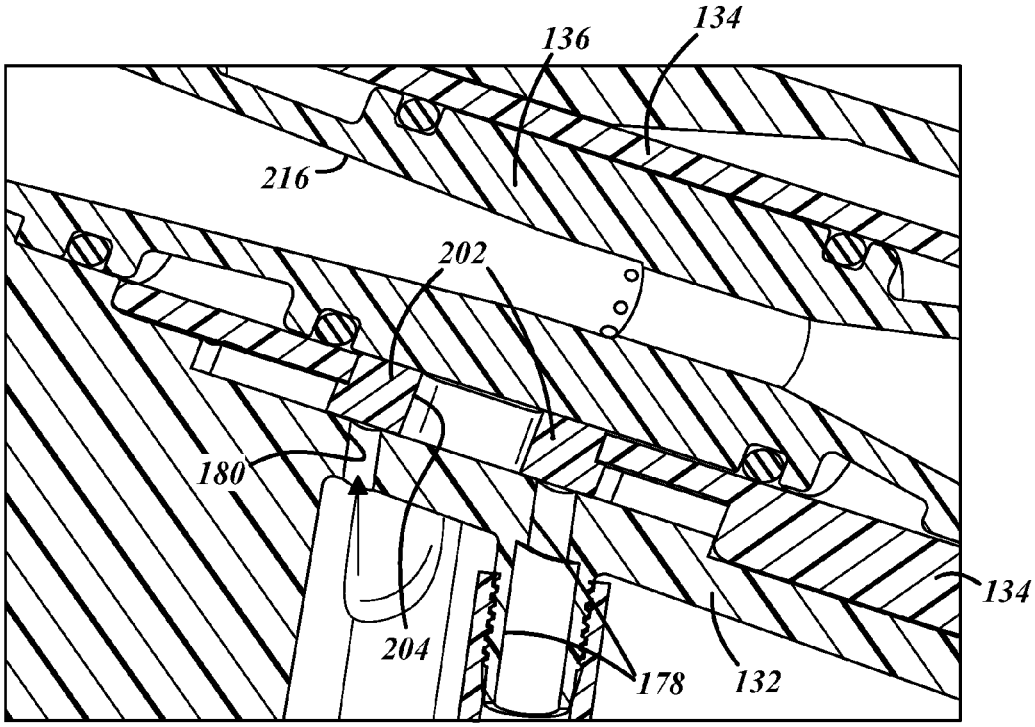
FIG. 26B is an enlarged cross-sectional view of the vent bore and inlet bore of FIG. 26A, shown in a closed state.
Figure 30:
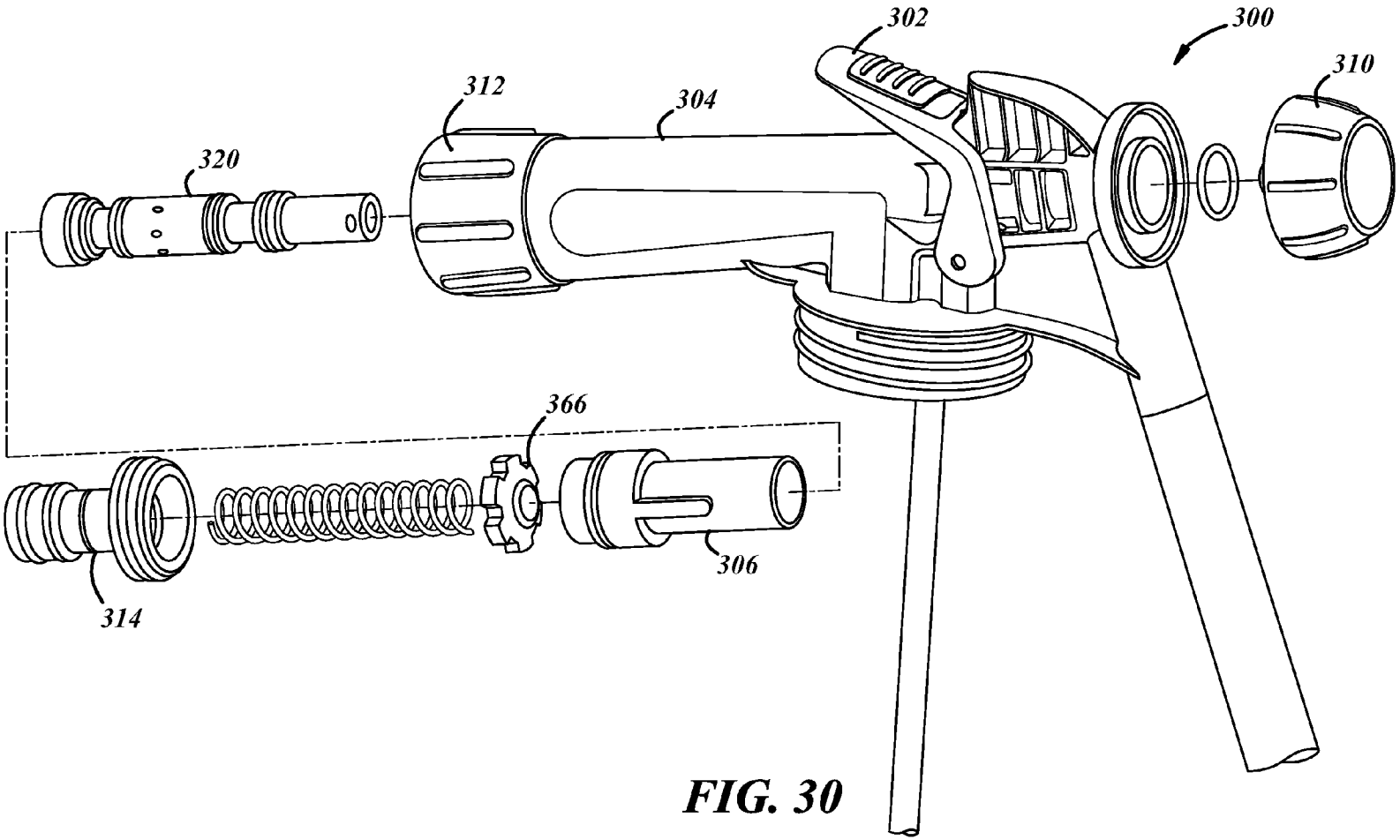
FIG. 30 is an exploded view of an illustrative embodiment of a dispenser device.
Figure 31:
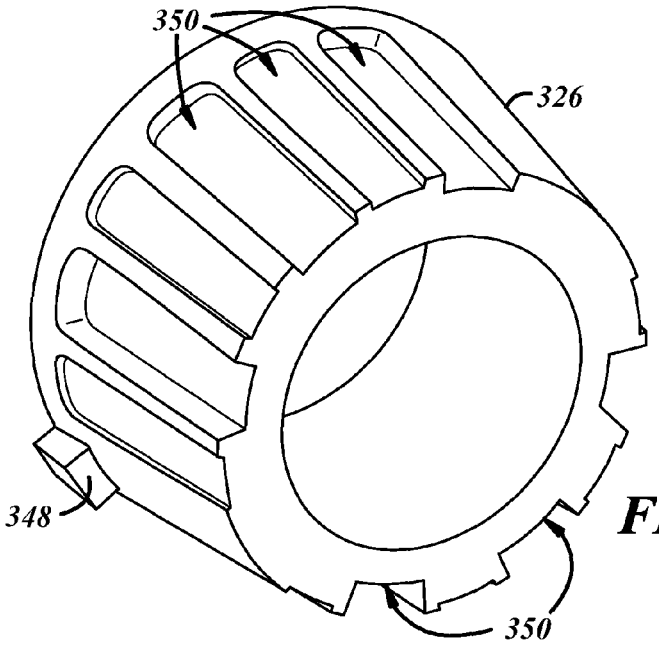
FIG. 31 is a perspective view of an illustrative embodiment of a passage component.

The connector assembly 142 may be used to semi-permanently connect the container 102 and the dispenser device 104 together. The connector assembly 142 may have various designs and constructions including that shown in FIGS. 23-25. In the illustrated embodiment, the connector assembly 142 may include a collar 254, a gasket 256, and heat stakes 258 (represented by arrows in FIG. 25), and may interact with the neck 108 of the container 102 and the neck 170 of the housing 132 during assembly. The collar 254 (shown in phantom in FIGS. 23 and 24) may be telescopically mated around and over both the neck 108 and the neck 170 when assembled. The collar 254 may have a ribbed outer surface 260, an internal and inwardly flexible lip 262, and internal threads 264. Before assembly, such as shown in FIGS. 23 and 24, the collar 254 may be loosely carried by the neck 108 of the container 102 via abutment between the lip 262 and the bottom edges 128 of the bulges 124. When assembled, such as shown in FIG. 25, the gasket 256 may be compressed between the container 102 and the housing 132 for sealing thereat, and the internal threads 264 may be tightened down and mated with the external threads 172 of the housing 132. Then, the heat stakes 258 may be injected through the collar 254 and through the neck 170 of the housing 132 in order to anchor the container 102 and the dispenser device 104 together. The heat stakes 258 may be injected at the circumferential position of the pockets 126 of the neck 108. In one case, the heat stakes 258 do not penetrate or otherwise make contact with the neck 108 of the container 102 in order to avoid the risk of puncturing the container and the resulting leaking of chemical out of the container; this purpose is facilitated by the pockets 126 which provide adequate spacing for protecting the container's neck from the heat stakes and heat emitted therefrom. The staked collar 254 and housing 132 may then remain connected to the container 102 by way of abutment between the lip 262 and the bottom edges 128 of the bulges 124. The heat stakes 258 may be used to provide a tamper-proof connection where the operator may not necessarily be able to disconnect the container 102 and the dispenser device 104. In other embodiments, the heat stakes 258 may not be used.

In the case of a cleaning solution concentrate, the dispenser device 104 may be but one component of a larger wall-mounted cleaning station assembly and system that may also include a wall-mounted unit for carrying and storing multiple containers of cleaning solution concentrate and multiple sources of pressurized diluent, in this case pressurized water. A single dispenser device 104 may be connected to a single container 102 of cleaning solution concentrate, and a single pressurized water hose may be connected to the single dispenser device. The source of pressurized water may be connected to the dispenser device 104 at the coupler 192 by way of, for example, a threaded hose connection, a press-fit connection, a snap-on connection, and/or the source of pressurized water may be a unitary extension of the dispenser device such as a hose extending therefrom. A bottle, bucket, or other receptacle may be placed at the outlet tube 166 in order to receive the diluted mixture.

Referring to FIGS. 15-18, in general operation, the user presses the trigger 130 which may cause the sleeve 134 to slide rearwardly—via the leg/nub engagement—in the direction of the inlet 158. The sliding sleeve 134 may then open the flow valve 138 against the exertion of the spring 208 and the exertion of the pressurized diluent flow, if present. Water may then rush through the primary passage 216 of the eductor 136, while simultaneously the gasket 202 may slide with the sleeve 134 and may thus bring the passage 204 into alignment with the inlet bore 178 of the housing 132. Once aligned, cleaning solution concentrate may be drawn through the inlet tube 184, through the inlet bore 178, through the passage 204, through one of the radially-extending passages of the eductor 136, and into the primary passage 216. At the intersection of the radially-extending passage and the primary passage 216, the cleaning solution concentrate may mix with the rushing water to produce the diluted mixture which then flows forwardly in the primary passage and out one of the passages 214 to the outlet 160.

Before the trigger 130 is pressed, in the illustrated embodiment, the user may set the dispenser device 104 in one of eight diluted mixture flow modes: an off or locked flow mode, a rinse flow mode, three low flow modes, and three high flow modes. In general, this may be accomplished by rotating the control knob 188 which may in turn generally circumferentially aligns and misaligns the radially-extending passages 218, 220, 222, 224, 226, 228 with the inlet bore 178 of the housing 132; in other words, rotating the control knob may bring one of the radially-extending passages to an angular position where it could fluidly communicate with the inlet bore of the housing, or to an angular position where none of the radially-extending passages could communicate with the inlet bore of the housing. The control knob 188 may be constructed with a detent which indexes proper rotational position of each of the flow modes; of course other ways of providing feedback to the user regarding the rotational position of the eductor 136 are possible such as constructing the eductor with detents. Depending in part upon the dimensions (e.g., diameters) of the radially-extending passages, each of the three low flow modes may produce a diluted mixture with a different weight or volume ratio of diluent-to-chemical concentrate, and, likewise, each of the three high flow modes may produce a diluted mixture with a different diluent-to-concentrate ratio. And in other embodiments, the dispenser device 104 may have more or less diluted mixture flow modes by respectively increasing and decreasing the number of radially-extending passages in the eductor 136.

Referring to FIGS. 15 and 20, in the locked flow mode, no water may flow through the primary passage 216 and no cleaning solution concentrate may be drawn through the radially-extending passages 218, 220, 222, 224, 226, 228. In this mode, the control knob 188 may rotate the eductor 136 so that none of the radially-extending passages are circumferentially aligned or otherwise can communicate with the inlet bore 178 of the housing 132. Here, the third step 238 may be positioned in direct longitudinal-confrontation and abutment with the step 200 of the sleeve 134. The confronting and abutting steps 238, 200 may altogether check and preclude the sleeve 134 from sliding. Consequently, the flow valve 138 may remain closed and the passage 204 of the gasket 202 may remain misaligned with the inlet bore 178 and the unpassaged portion of the gasket may block and seal the inlet bore against communication with the eductor 136.

Figure 16:
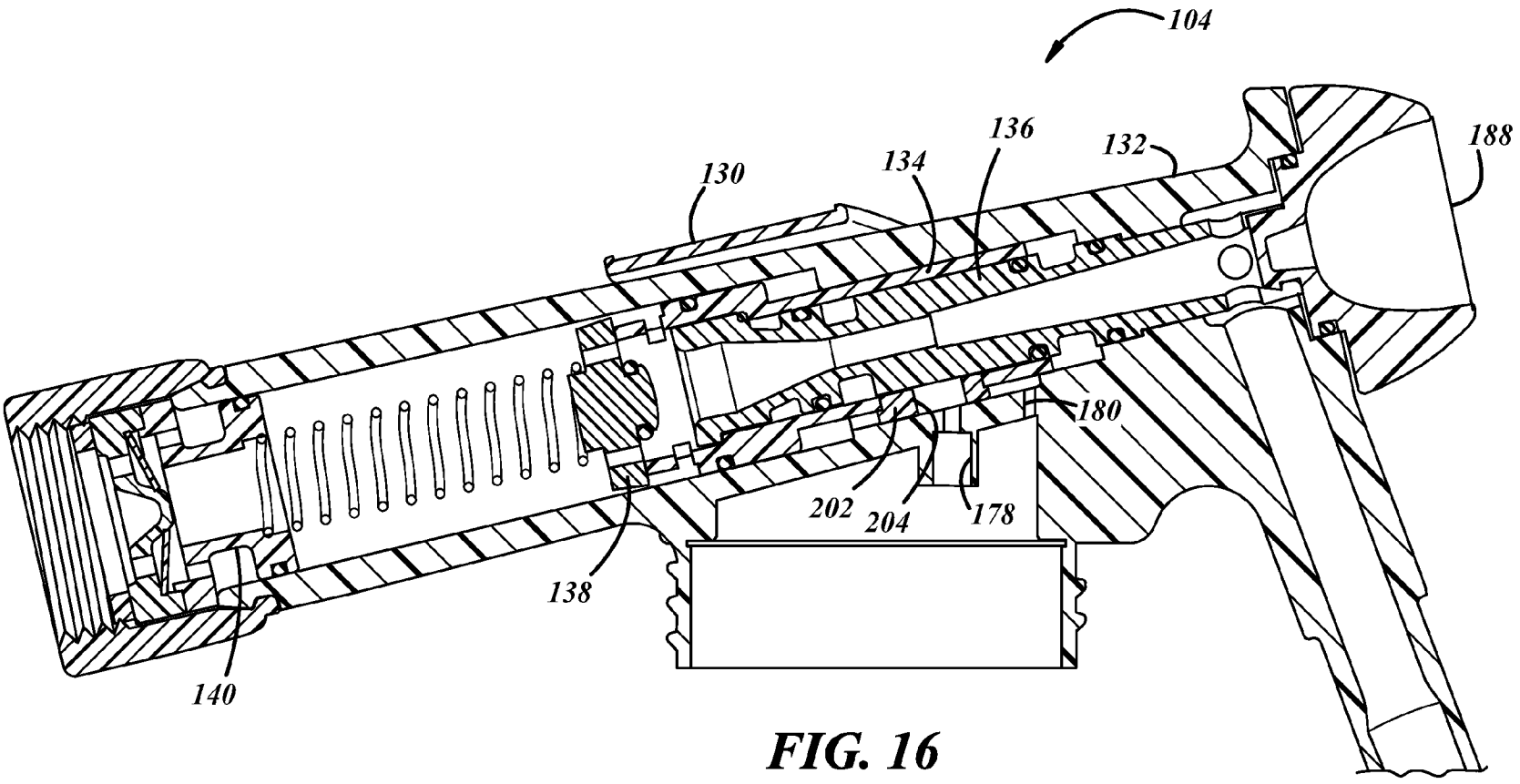
FIG. 16 is a cross-sectional view of the dispenser device of FIG. 9, showing the dispenser device set in a rinse flow mode.
Figure 22:
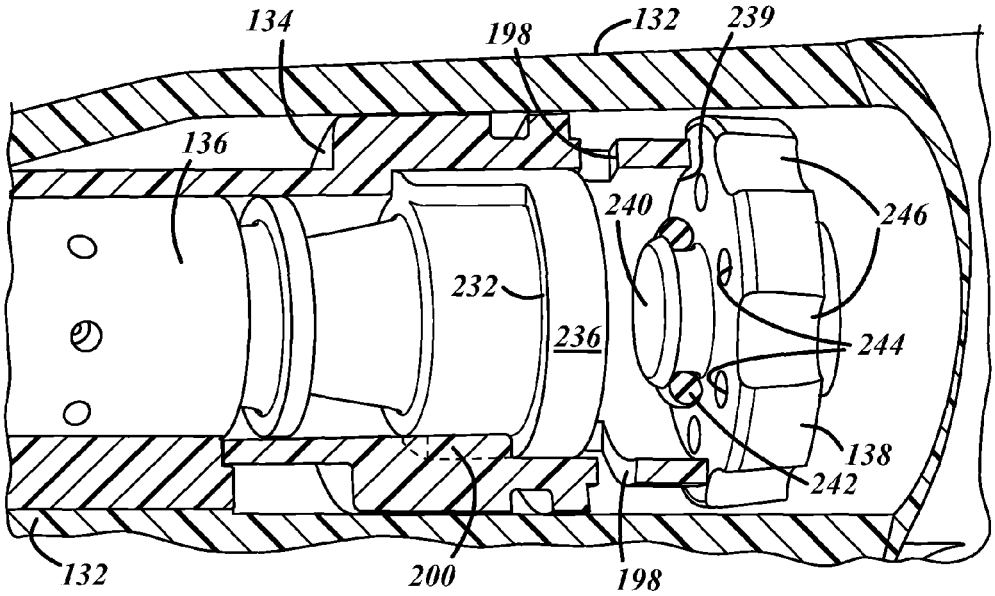
FIG. 22 is an enlarged cross-sectional view of the dispenser device of FIG. 12.

Referring to FIGS. 16 and 22, in the rinse flow mode, water may rush through the primary passage 216 at a relatively high and maximum volumetric flow rate, and no cleaning solution concentrate may be drawn through the radially-extending passages. In this mode, the control knob 188 may rotate the eductor 136 so that none of the radially-extending passages are circumferentially aligned or otherwise communicate with the inlet bore 178 of the housing 132. Here, the step 200 of the sleeve 134 may be positioned in direct longitudinal-confrontation and circumferential alignment with the second groove 232 of the eductor 136. The second longitudinal length may permit sliding movement of the sleeve 134 to a degree which separates the flow valve 138 from the eductor 136 and which correspondingly opens the flow valve to a maximum-volumetric-flow-rate position. Water may then flow through the inner passages 244 and outer recesses 246 of the flow valve 138, and through the passages 198 of the sleeve 134. Though in this mode the passage 204 of the gasket 202 may be aligned or may otherwise communicate with the inlet bore 178, no cleaning solution concentrate is drawn to the eductor 136 because none of its radially-extending passages communicate with the passage of the gasket.

Figure 17:
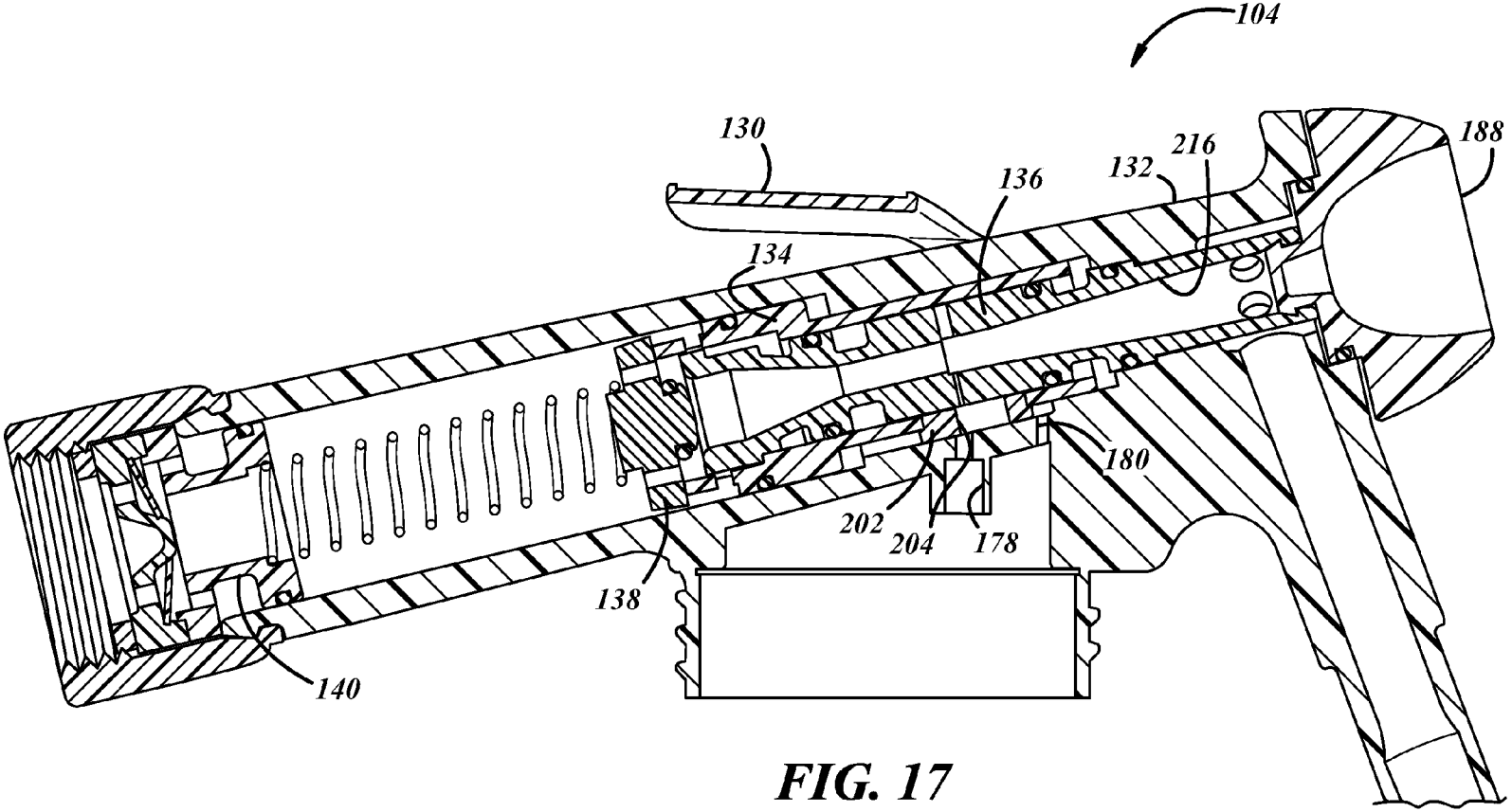
FIG. 17 is a cross-sectional view of the dispenser device of FIG. 9, showing the dispenser device set in a low flow mode.
Figure 21:
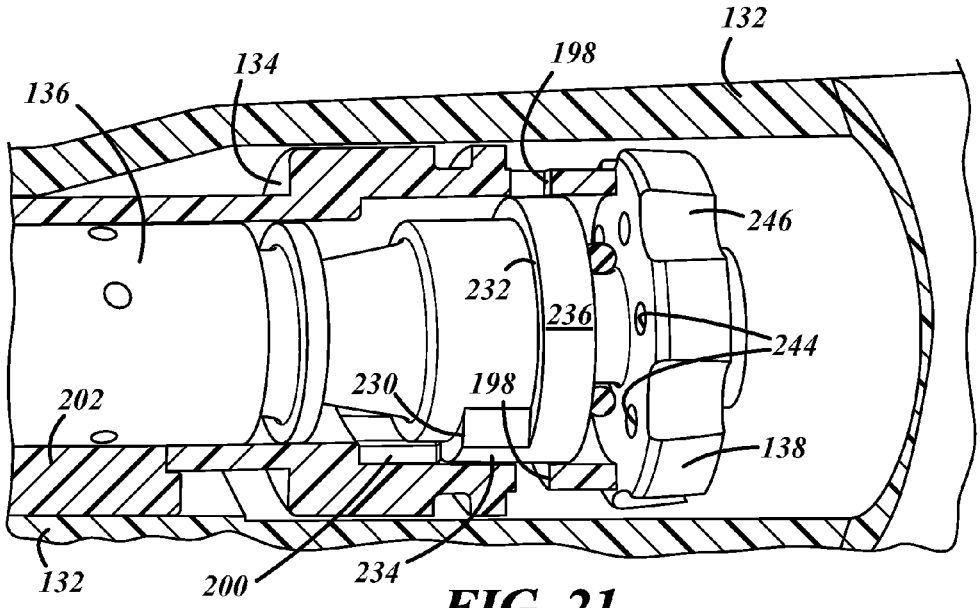
FIG. 21 is an enlarged cross-sectional view of the dispenser device of FIG. 12.

Referring to FIGS. 17 and 21, in the three low flow modes, water may rush through the primary passage 216 at a relatively low and minimum volumetric flow rate, and cleaning solution concentrate may be drawn through one of the radially-extending passages to mix with the water and produce a diluted mixture. In this mode, the control knob 188 may rotate the eductor 136 so that one of the first, second, or third passages 218, 220, 222 is circumferentially aligned with or otherwise communicates with the inlet bore 178 of the housing 132. In any one of these alignments, the step 200 of the sleeve 134 may be positioned in direct longitudinal-confrontation and circumferential alignment with the first groove 230 of the eductor 136. The first longitudinal length $L_1$ may permit sliding movement of the sleeve 134 to a degree which separates the flow valve 138 from the eductor 136 and which correspondingly opens the flow valve to a minimum-volumetric-flow-rate position. Water may then flow through the inner passages 244 of the flow valve 138, but may not flow through the outer recesses 246 of the flow valve or the passages 198 of the sleeve 134 and into the primary passage 216.

The three low flow modes may produce a diluted mixture with different weight or volume ratios of diluent-to-chemical concentrate, but at substantially the same minimum volumetric flow rate. For example, the first passage 218 may have a first diameter that may draw-in a predetermined volumetric flow rate of cleaning solution concentrate, and that in turn may produce a diluted mixture with a ratio of diluent-to-concentrate of 20:1. Likewise, the second passage 220 may have a smaller second diameter that may produce a diluted mixture with a ratio of 64:1, and the third passage 222 may have an even smaller third diameter that may produce a diluted mixture with a ratio of 256:1. Furthermore, the three low flow modes may expel a diluted mixture at about 1.0 to 1.5 gpm. Of course, other ratios of diluent-to-concentrate are possible and will depend on, among other factors, the exact chemical concentrate used. Likewise, the diluted mixture may be expelled at other volumetric flow rates in these modes.

Figure 18:
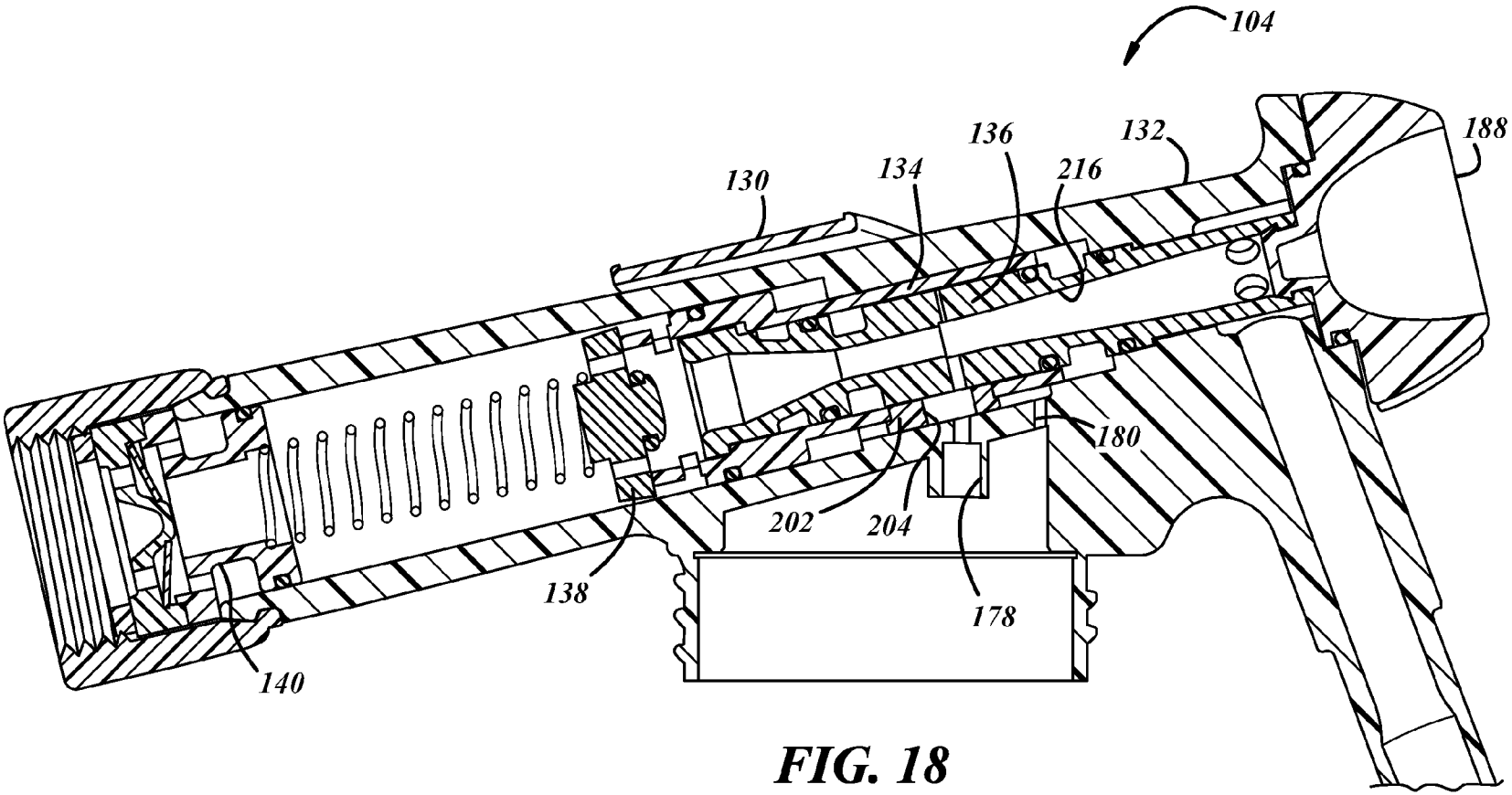
FIG. 18 is a cross-sectional view of the dispenser device of FIG. 9, showing the dispenser device set in a high flow mode.

Referring to FIGS. 18 and 22, in the three high flow modes, water may rush through the primary passage 216 at a relatively high and maximum volumetric flow rate, and cleaning solution concentrate may be drawn through one of the radially-extending passages to mix with the water and produce a diluted mixture. In this mode, the control knob 188 may rotate the eductor 136 so that one of the fourth, fifth, or sixth passages 224, 226, 228 is circumferentially aligned with or otherwise communicate with, the inlet bore 178 of the housing 132. In any one of these alignments, the step 200 of the sleeve 134 may be positioned in direct longitudinal-confrontation and circumferential alignment with the second groove 232 of the eductor 136. The second longitudinal length $L_2$ may permit sliding movement of the sleeve 134 to a degree which separates the flow valve 138 from the eductor 136 and which correspondingly opens the flow valve to a maximum-volumetric-flow-rate position. Water may then flow through the inner passages 244 and outer recesses 246 of the flow valve 138, and through the passages 198 of the sleeve 134 and into the primary passage 216.

The three high flow modes may produce a diluted mixture with different weight or volume ratios of diluent-to-chemical concentrate, but at substantially the same maximum volumetric flow rate. For example, the fourth passage 224 may have a fourth diameter that may draw-in a predetermined volumetric flow rate of cleaning solution concentrate, and that in turn may produce a diluted mixture with a ratio of diluent-to-concentrate of 20:1. Likewise, the fifth passage 226 may have a smaller fifth diameter that may produce a diluted mixture with a ratio of 64:1, and the sixth passage 228 may have an even smaller sixth diameter that may produce a diluted mixture with a ratio of 256:1. Furthermore, the three high flow modes may expel a diluted mixture at about 3.5 to 4.0 gpm. Of course, other ratios of diluent-to-concentrate are possible and will depend on, among other factors, the exact chemical concentrate used. Likewise, the diluted mixture may be expelled at other volumetric flow rates in these modes.

In other illustrative embodiments of FIGS. 30-47, a dispenser device 300 may be similar in some ways to the dispenser devices 10 and 104 already described with reference to FIGS. 1-29. Some of these similarities may not be repeated here for the embodiments of FIGS. 30-47. For example, the dispenser device 300 may include a similar trigger 302 as already described, a similar housing 304 as already described, a similar sleeve 306 as already described, a similar backflow valve 308 as already described, and a similar connector assembly (not shown) as already described. Furthermore, the trigger 302 and the sleeve 30 may have a similar leg/nub engagement as already described; the housing 304 may have a similar inlet and similar first and second vent bores as already described; the housing 304 may have a similar control knob 310 and similar connector 312 and similar coupler 314 as already described; the sleeve 306 may have a similar step 316 and similar gasket 318 as already described; and, the similar step 316 may interact with a similar first and second eductor groove as already described and with a similar first and second and third eductor steps as already described.

Figure 35:
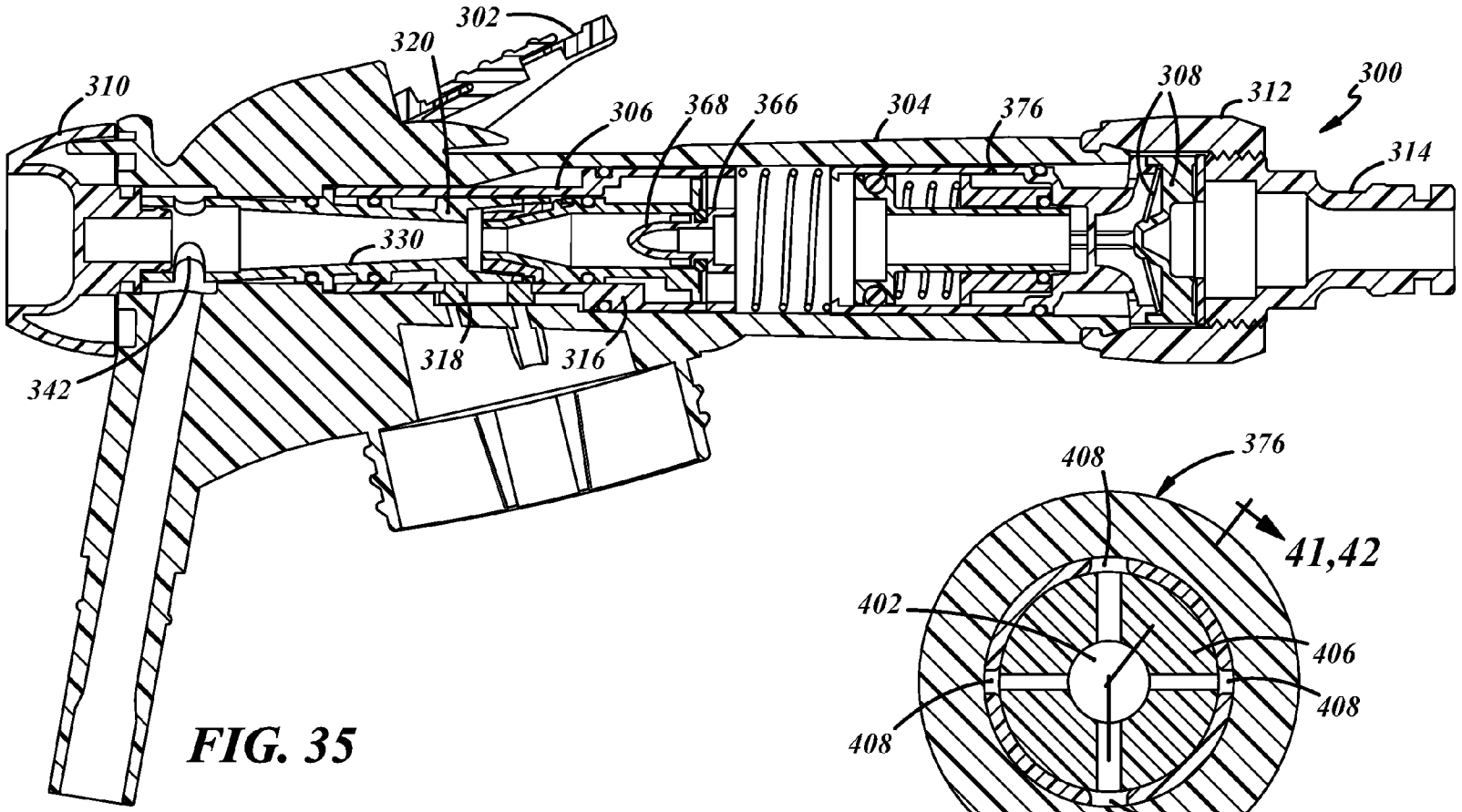
FIG. 35 is a cross-sectional view of an illustrative embodiment of a dispenser device.
Figure 44:
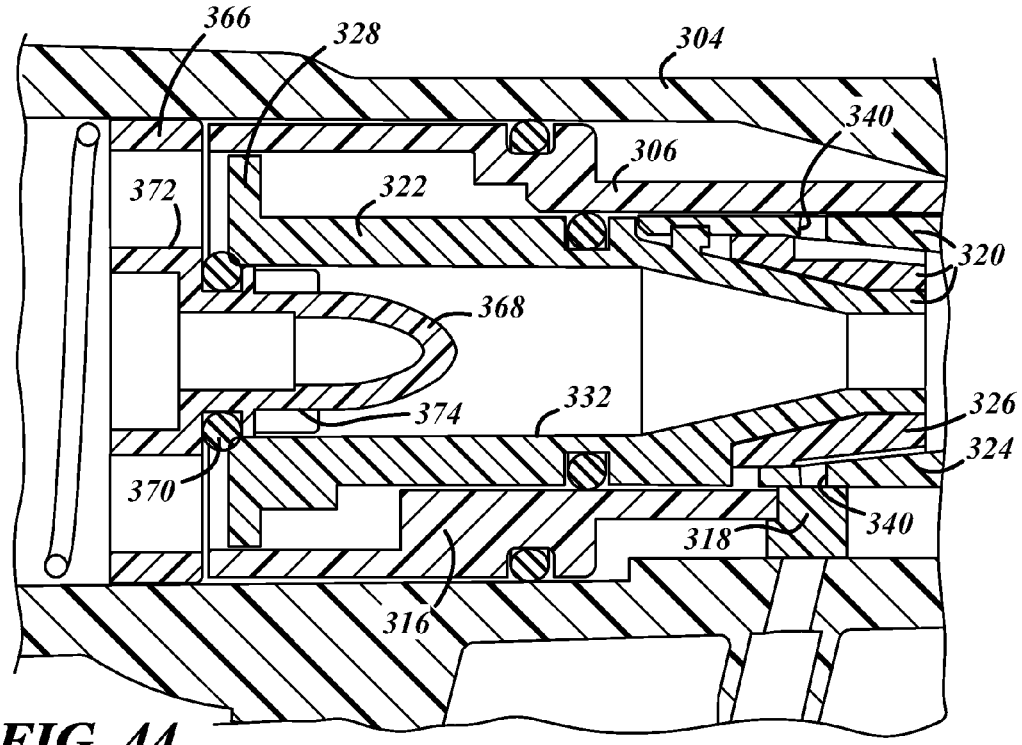
FIG. 44 is a cross-sectional view of an illustrative embodiment of a flow valve of the dispenser device of FIG. 35.
Figure 45:
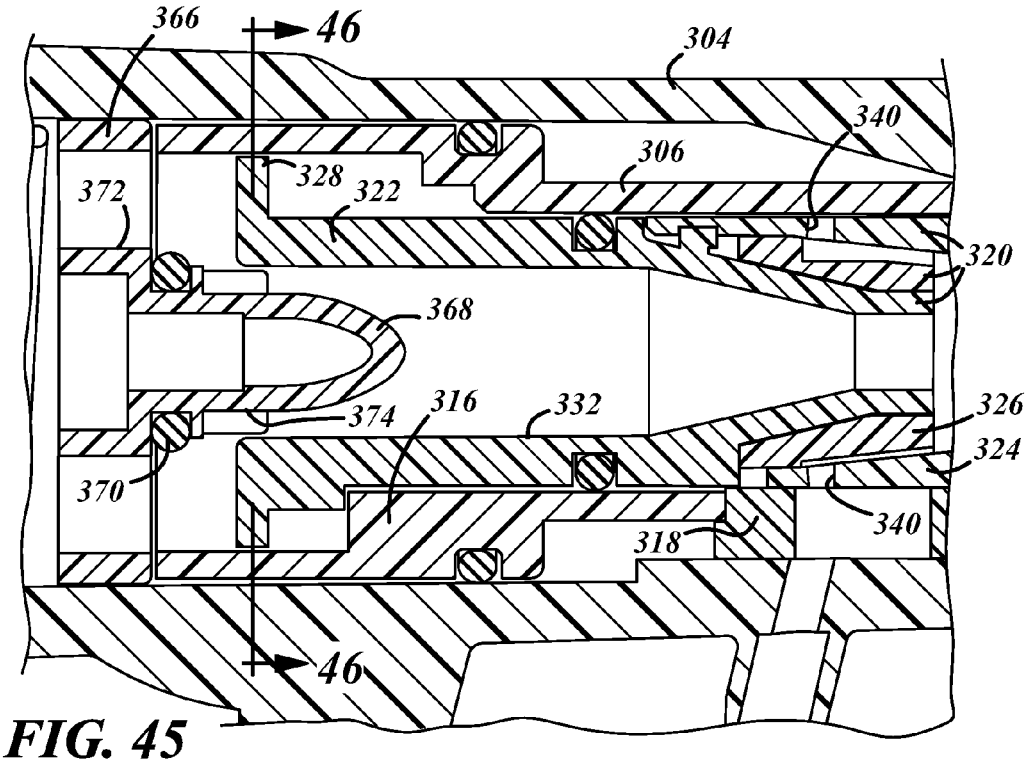
FIG. 45 is a cross-sectional view of the flow valve of FIG. 44.
Figure 46:
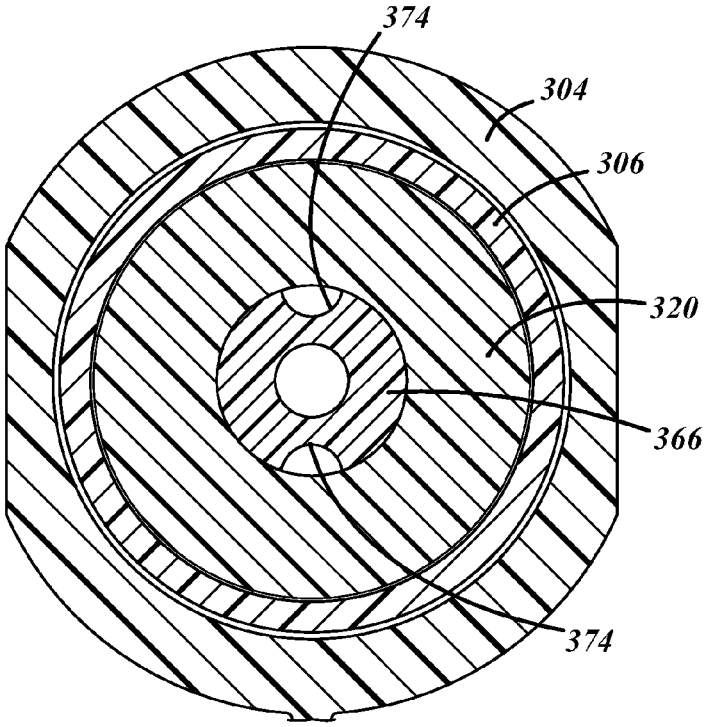
FIG. 46 is a cross-sectional view taken at line 46-46 in FIG. 45.
Figure 47:
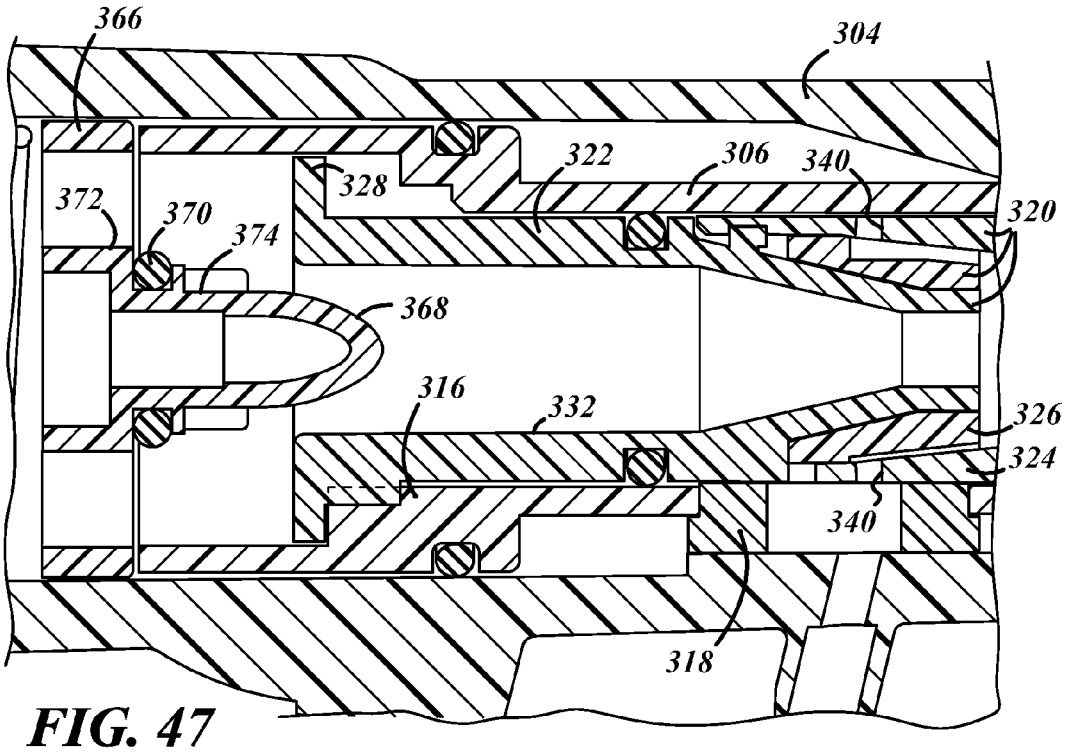
FIG. 47 is a cross-sectional view of the flow valve of FIG. 44.

Referring to FIGS. 35 and 44, one difference between the sleeve 306 and the sleeve 134 already described is that the sleeve 306 may not have passages for diluent flow. The dispenser device 300 may further include an eductor 320 which may be a multi-piece component. In the illustrative embodiment of FIGS. 36 and 37, the eductor 320 may include three separate and distinct components—namely, a first component 322, a second component 324, and a passage component 326. The first component 322 may have a flange 328 at its terminal inlet end that may accommodate suitable telescopic assembly with the sleeve 306 (FIG. 44), and that may prevent diluent flow from getting between an outside surface of the first component and an inside surface of the sleeve. In assembly, the first component 322 and the second component 324 may be concentrically and axially aligned with respect to each other, and may together define a primary passage 330. Isolated, the first component 322 may define a first portion 332 of the primary passage 330, and the second component 324 may define a second portion 334 of the primary passage.

Adjacent an interface or confrontation region of the first and second components 322, 324, there may be a mixture portion 336 of the primary passage 330 where the diluent flow and the cleaning solution concentrate flow may mix with each other to form the diluted mixture. At an inlet end where the first component 322 may initially receive incoming diluent flow, the first component may have a first section of uniform diameter; and downstream the first section near a discharge end, the first component may have a generally narrowing-cone shaped section in the forward fluid-flow direction; and further downstream, the first component may have a second section of uniform diameter.

Figure 32:
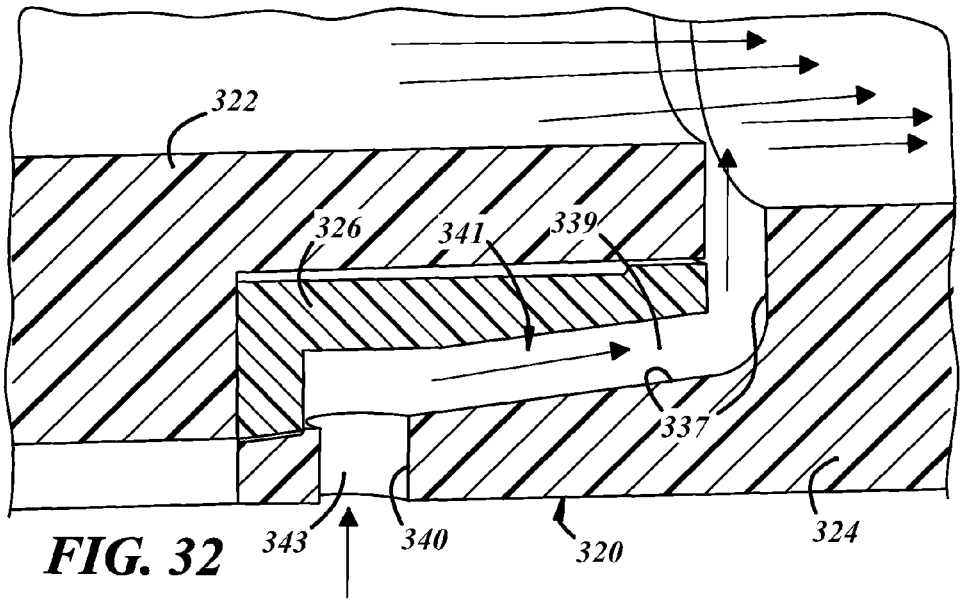
FIG. 32 is an enlarged cross-sectional view of the passage component of FIG. 31.
Figure 34:
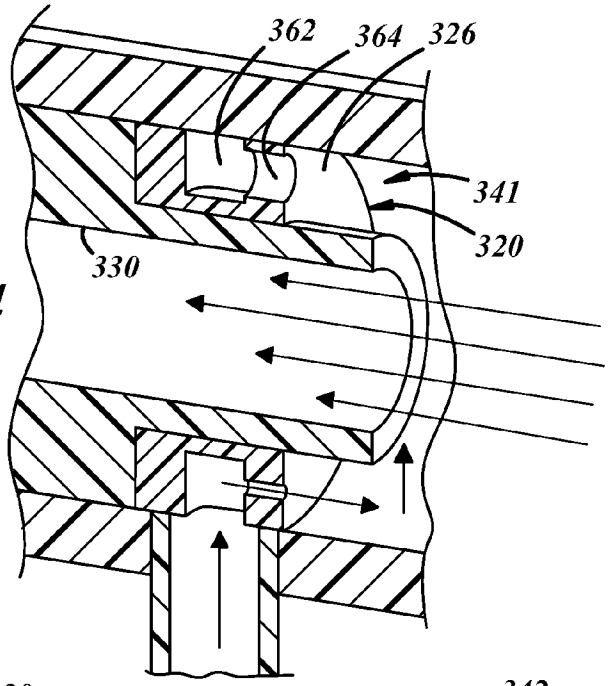
FIG. 34 is a cross-sectional view of an illustrative embodiment of a passage component.
Figure 33:
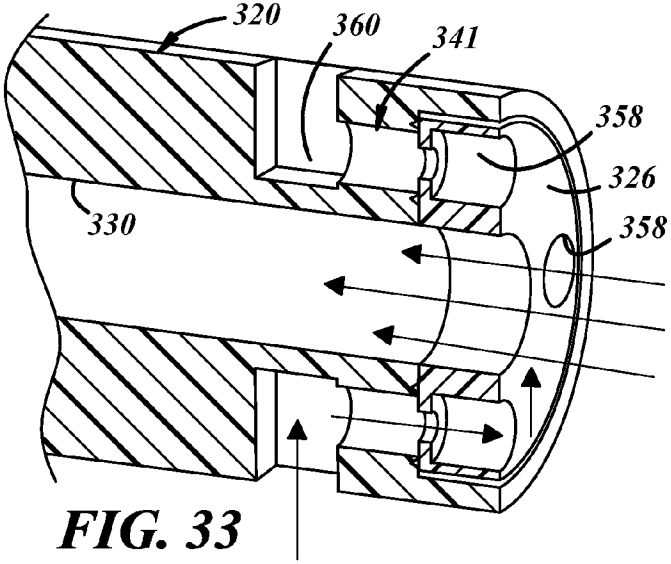
FIG. 33 is a cross-sectional view of an illustrative embodiment of a passage component.
Figure 36:
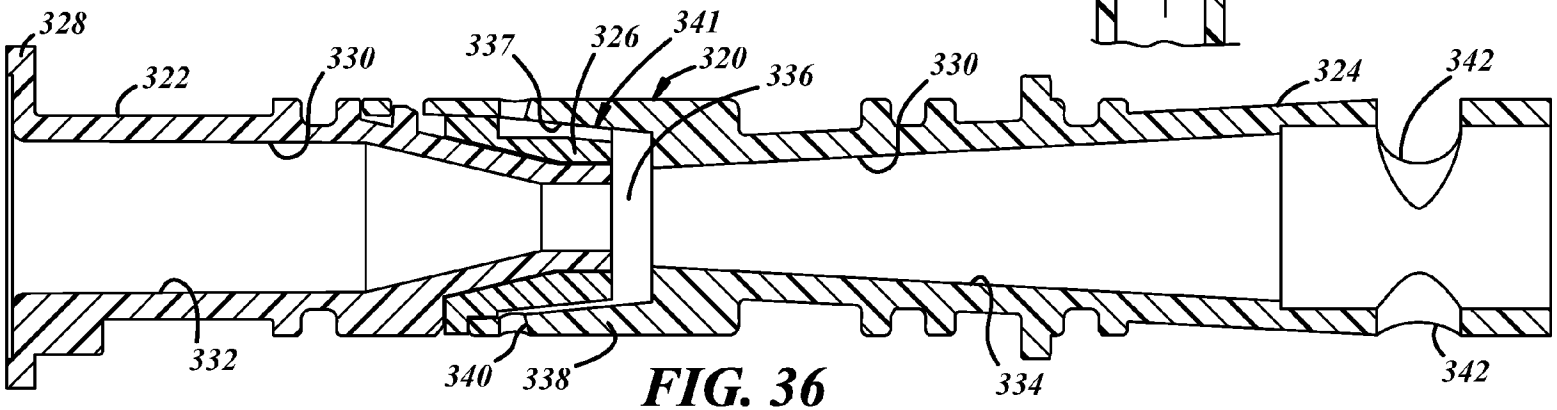
FIG. 36 is a cross-sectional view of an illustrative embodiment of an eductor of the dispenser device of FIG. 35.

Referring to FIGS. 32, 35, and 44, the second component 324 may telescopically receive at least a portion of the first component 322 in assembly—in this case a discharge end portion of the first component—and may be located generally downstream of the first component with respect to the direction of diluent flow. The second component 324 may have a reception section 338 that may telescopically receive both the first component 322 and the passage component 326. In the illustrated embodiments, the reception section 338 may have an interconnecting structure which complements an interconnecting structure of the first component 322 for a snap-fit connection therebetween; in other embodiments, the connection between the first and second components can be constructed and designed in different ways such as by press-fit, male/female mating structures, adhesion, or another way. The reception section 338 may have a diameter greater in value than that of the discharge end portion of the first component 322, and greater than that of the passage component 326 in order to facilitate the telescopic relationship. The reception section 338 may have an interior surface 337 which may be generally radially-inwardly directed and which may also be generally axially directed (both directions best shown in FIG. 32). The interior surface 337 may directly confront the passage component 326. In certain circumstances, the interior surface 337 and the passage component 326 may together define and constitute a first portion 339 of a chemical concentrate passage 341 through which unmixed chemical concentrate may flow and no diluent may flow. The second component 324 may define one or more passages 340 for cleaning solution concentrate flow, and which may constitute a second portion 343 of the chemical concentrate passage 341. The second portion 343 may be located upstream of the first portion 339. The first and second portion 339, 343 may constitute the entire chemical concentrate passage 341, or there may be another portion in addition to the first and second portions and upstream or downstream of the first and second portions. The passages 340 may be generally radially extending, and may directly communicate with and may confront the passage component 326. In the illustrated embodiment of FIGS. 32, 36, and 37, the passages 340 may extend in a single direction without any substantial turns or misdirections, while the entire chemical concentrate passage 341 may extend in three directions in a Z- or S-shaped path; other directions and paths are possible. The passages 340 may have different dimensions with respect to one another for different predetermined volumetric flow rates of cleaning solution concentrate, or may have the same dimension. The second component 324 may also have a generally and gradually widening cone-shape downstream of the reception section 338, and may have passages 342 which may communicate with an outlet tube and which may direct the resulting diluted mixture into the outlet tube. And the second component 324 may further have a fixed connection to the control knob 310.

The passage component 326 may define a portion or more of the chemical concentrate passage 341. In different embodiments, the passage component 326 may define one or more surfaces of the chemical concentrate passage 341, one or more axial segments of the total axial extent of the chemical concentrate passage, or another surface or portion of the chemical concentrate passage. The passage component 326 may be assembled to the first component 324 by a number of ways including snap-fitting, press-fitting, or ultrasonic welding; likewise, the passage component may be assembled to the second component 324, or may be assembled to both of the first and second components. Referring to the illustrated embodiment of FIGS. 36-38, the passage component 326 may have a generally conical shape and may extend from a first terminal end 344 to a second terminal end 346. In one embodiment, the passage component 326 may have a female portion to receive a complementary male portion of the first and/or second components 322, 324. Adjacent the first terminal end 344, the passage component 326 may have radially-outwardly extending tangs 348 that are circumferentially offset with respect to one another. The tangs 348 may be used to facilitate the connection among the passage component 326 and the first and second components 322, 324.

In the illustrated embodiment, the passage component 326 may have one or more grooves 350 that may be located on a radially-outwardly-most surface of the passage component, and that may be circumferentially offset with respect to one another. The grooves 350 may define a portion or more of the chemical concentrate passage 341, such as with the interior surface 337 of the reception section 338, or with another surface. The grooves 350 may have different shapes, dimensions, and/or sizes with respect to one another in order to provide different predetermined volumetric flow rates of cleaning solution concentrate. For example, the grooves 350 may have different radial depths, may have different circumferential widths, and may have different axial lengths. In the illustrated embodiment of FIGS. 36-38, each groove 350 may have a generally rectangular shape, and may have a closed end 352 at an axially-rearwardly-location thereof, may have an open end 354 at an axially-forwardly-location thereof, and may have an open end 356 at a radially-outwardly-location thereof. In the illustrated embodiment of FIG. 31, the passage component 326 may include a greater number of grooves 350 than that of FIG. 38. In the illustrated embodiment of FIG. 33, the passage component 326 may be generally ring-shaped and may be assembled on a terminal end of the eductor 320. The passage component 326 may define one or more axially extending passages 358 for cleaning solution concentrate flow, and which may constitute an axial segment of the chemical concentrate passage 341. The passages 358 may be located downstream of, and may directly communicate with, L-shaped passages 360 of the eductor 320. The passages 358 may have different dimensions with respect to one another for different predetermined volumetric flow rates of cleaning solution concentrate or may be orificed with different dimensional orifices. In the illustrated embodiment of FIG. 34, the passage component 326 may be generally ring-shaped and may be assembled on a terminal end of the eductor 320. The passage component 326 may define one or more axially and radially extending passages 362 for cleaning solution concentrate flow, and which may constitute a substantial segment of the chemical concentrate passage 341. The passages 362 may be generally L-shaped and may have portions 364 that may have different dimensions with respect to one another for different predetermined volumetric flow rates of cleaning solution concentrate.

In manufacturing, the first component 322, the second component 324, and the passage component 326 may be made in separate and independent manufacturing processes, though need not be in all cases. For example, the first and second components 322, 324 may be made by an injection molding process. The passage component 326 may also initially be made by an injection molding process, but then may be subject to a comparatively more precise manufacturing process in order to machine the grooves 350. In another example, the passage component 326 may not need the comparatively more precise manufacturing process in order to machine the grooves 350; this may be the case when the grooves are designed and constructed according to the embodiment shown in FIG. 38. Because the passage component 326 is manufactured separately, the dispenser device 300 may accommodate different chemicals and different applications by modifying the design and dimensions of the passage component. Moreover, the manufacturing processes may be one reason why the eductor 320 is a multi-piece component; of course, other reasons may exist.

The dispenser device 300 may further include a flow valve 366. In the illustrated embodiment of FIGS. 44-47, the flow valve 366 may have a plug portion 368 and an o-ring 370 therearound. The plug portion 368 may be inserted into the primary passage 330 of the eductor 320 when the flow valve is closed and sealed. The flow valve 366 may have passages 372 and may have recesses 374. In FIG. 44, the flow valve 366 is shown in a closed state; in FIG. 45, the flow valve is shown in an open state when the dispenser device 300 is set in the low flow mode; and in FIG. 47, the flow valve is shown in an open state when the dispenser device 300 is set in the high flow mode.

The dispenser device 300 may also include a flow control assembly 376. In general, the flow control assembly 376 may be used to equalize incoming diluent flow pressures. For example, an incoming diluent flow may have a first pressure value as it enters the flow control assembly 376, and may exit the flow control assembly at a second pressure value that may be lesser in value than the first pressure value; another incoming diluent flow may have a third pressure value as it enters the flow control assembly, and may exit the flow control assembly at the second pressure value or at another pressure value. The second pressure value may be lesser in value than the third pressure value. In this way, the diluent fluid-flow may be provided to the flow valve 366 and to the eductor 320 generally at a desired pressure value despite the incoming pressure value of the diluent source. In some embodiments, the desired pressure value may be dictated in part by the spring rate of a provided spring. In the illustrated embodiments of FIGS. 39-43, the flow control assembly 376 may be located internally within the housing 304, and may be a part of the dispenser device 300 as opposed to being an external component that is provided remotely of the housing such as in a water hose, though this may be the case in other embodiments. The flow control assembly 376 may be connected to the housing 304 in various ways including, for example, by snap-fitting, press-fitting, male/female mating structures, and adhesion. The flow control assembly 376 may be located upstream of the flow valve 366 and upstream of the eductor 320.

The flow control assembly 376 may have various designs and constructions. In the illustrated embodiment of FIGS. 39 and 40, the flow control assembly 376 may include a valve 378, a plate 380, and a spring 382. The flow control assembly 376 may also include other components such as gaskets 384 and housing members 386. The housing members 386 may be telescopically received in the housing 304.

Figure 39:
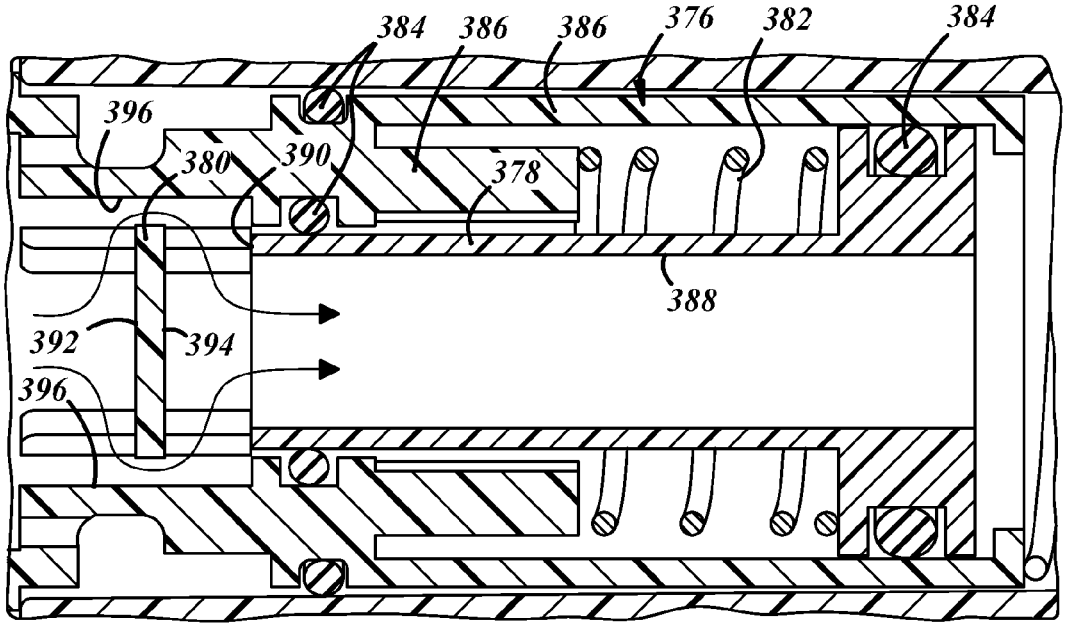
FIG. 39 is a cross-sectional view of an illustrative embodiment of a flow control assembly of the dispenser device of FIG. 35.
Figure 40:
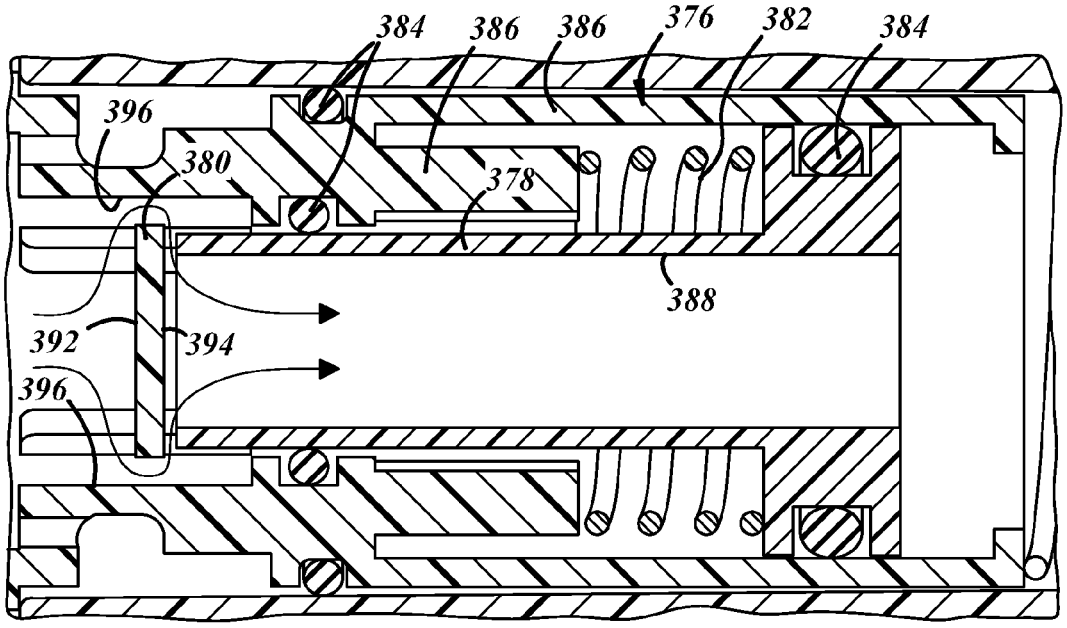
FIG. 40 is a cross-sectional view of the flow control assembly of FIG. 39.

Some of the housing members 386 may have a fixed connection to the housing 304, though need not in which case the valve 378 may have a fixed connection to the housing. The valve 378 may open and close in response to incoming diluent flow, and may have a flow passage 388 through which diluent may flow. The valve 378 may have a sealing edge 390 at a terminal end thereof. The plate 380 may have a confrontation surface 392 and a sealing surface 394 located opposite the confrontation surface. The confrontation surface 392 may directly confront at least a portion of the incoming diluent flow and may receive an exertion force from the incoming diluent flow. Peripheral flow passages 396 may be located around the plate 380. The spring 382 may bias the valve 378 and the plate 380 away from each other. In use, a comparatively low incoming pressure value of diluent flow may not cause the valve 378 and the plate 380 to move toward each other a substantial amount, keeping the sealing edge 390 and the sealing surface 394 apart to create a relatively increased space for diluent flow therethrough (this is shown in FIG. 39). A comparatively high incoming pressure value of diluent flow, on the other hand, may cause the valve 378 and the plate 380 to move toward each a substantial amount whereby the sealing edge 390 and the sealing surface 394 are nearly abutting to create a relatively decreased space for diluent flow (this is shown in FIG. 40).

Figure 43:
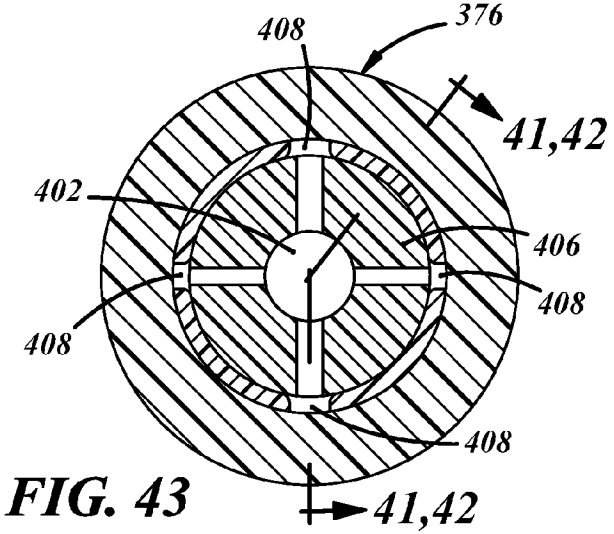
FIG. 43 is a cross-sectional view of the flow control assembly of FIG. 41, showing the angular position of the cross-sections of FIGS. 41 and 42.
Figure 37:
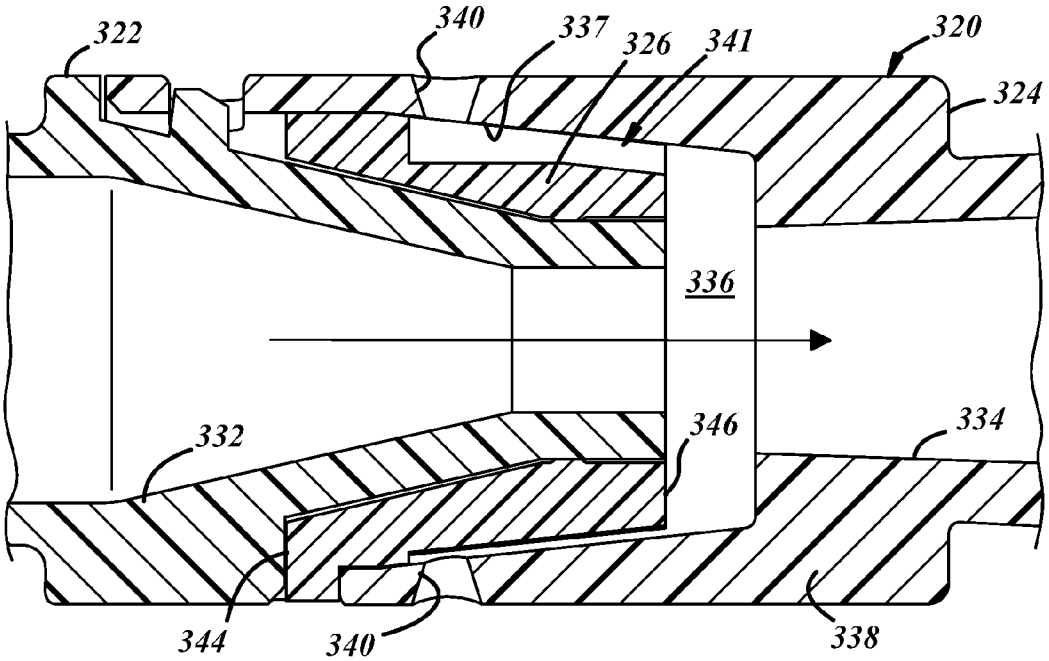
FIG. 37 is an enlarged cross-sectional view of the eductor of FIG. 36.
Figure 38:
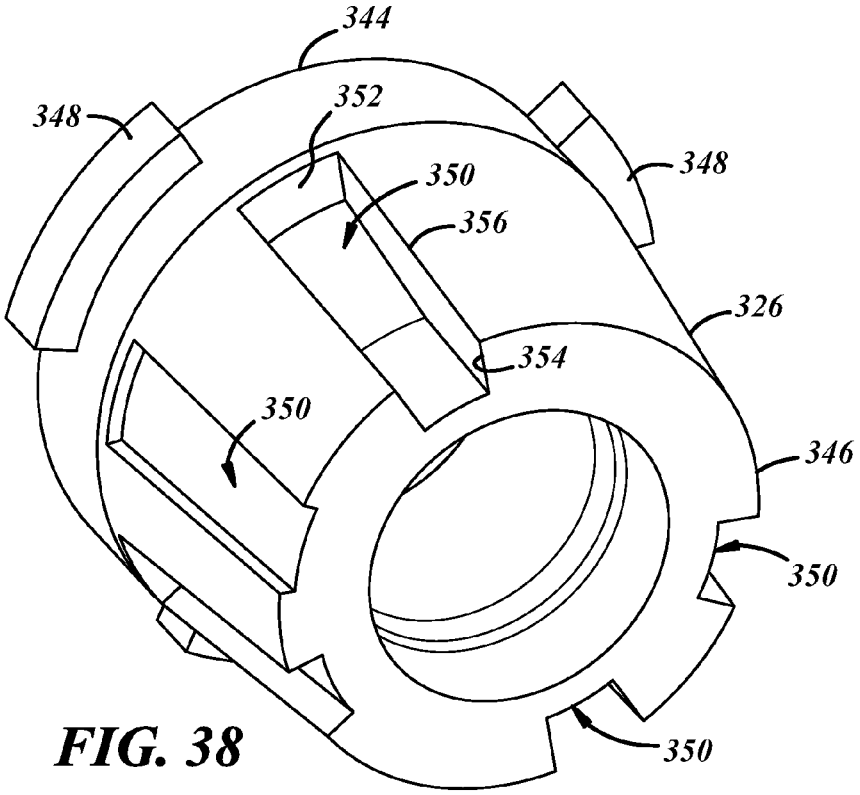
FIG. 38 is a perspective view of an illustrative embodiment of a passage component of the eductor of FIG. 36.
Figure 41:
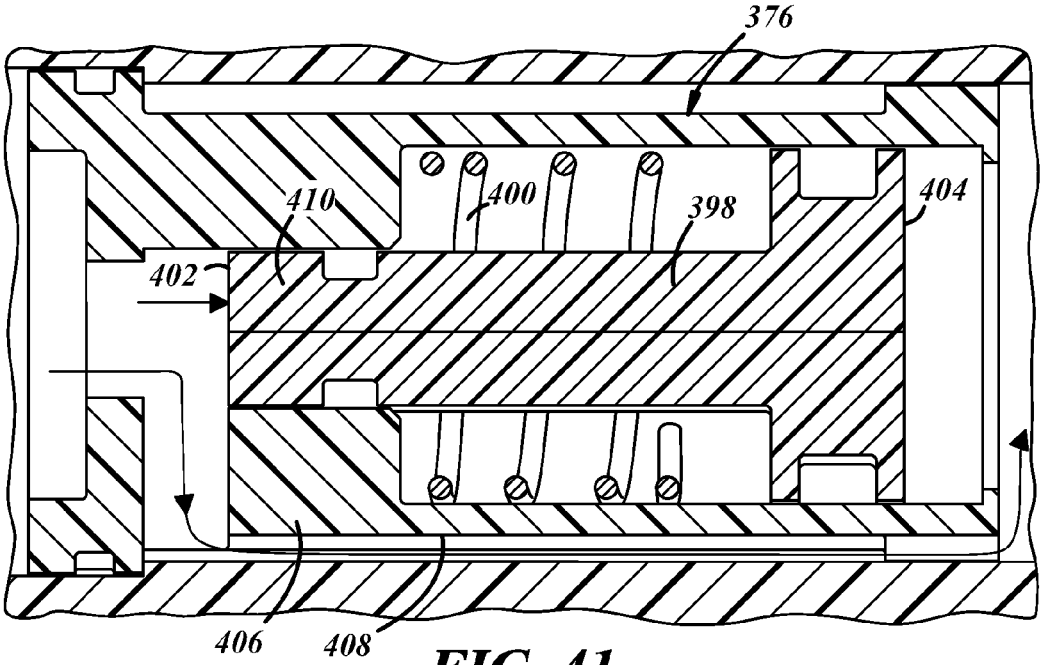
FIG. 41 is a cross-sectional view of an illustrative embodiment of a flow control assembly of the dispenser device of FIG. 35.
Figure 42:
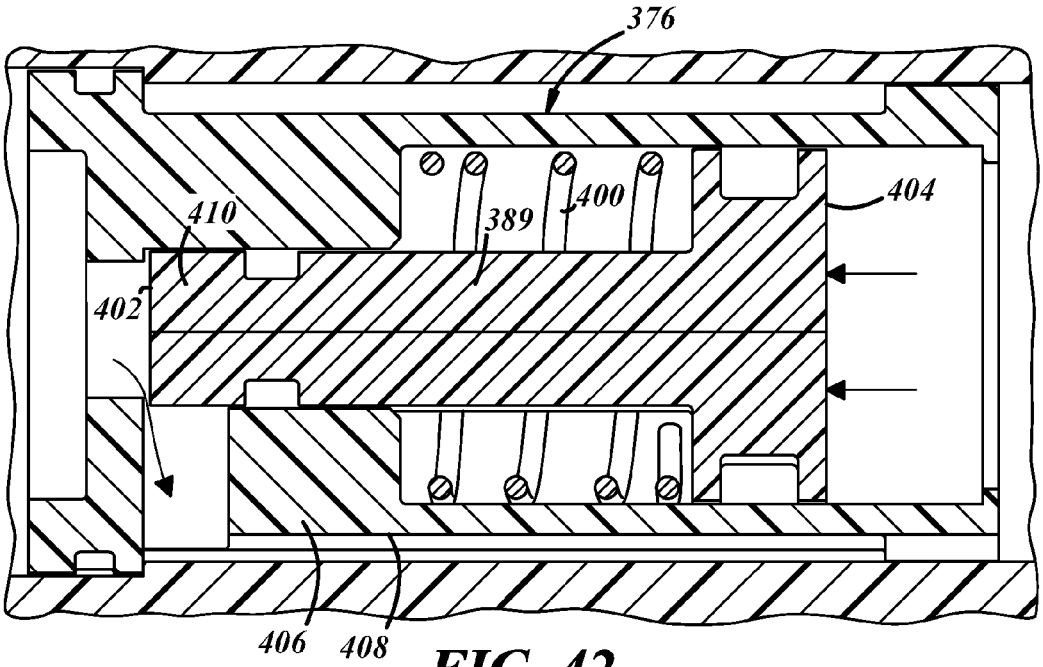
FIG. 42 is a cross-sectional view of the flow control assembly of FIG. 41.

In the illustrated embodiment of FIGS. 41-43, the flow control assembly 376 may include a valve 398 and a spring 400. FIG. 43 illustrates the angular positions at which the cross-sections are taken for FIGS. 41 and 42. The valve 398 may have a confrontation surface 402 that may directly confront at least a portion of the incoming diluent flow and may receive an exertion force from the incoming diluent flow. The confrontation surface 402 may have a first area value. The valve 398 may have a radially-outwardly-expanded portion with a back surface 404. The back surface 404 may have a second area value that is greater in value that the first area value of the confrontation surface 402. The flow control assembly 376 may further include a housing member 406 which may at least partially define peripheral passages 408 for diluent fluid flow (represented by arrows in FIG. 41). In use, a sealing portion 410 of the valve 398 moves back-and-forth to respectively permit and prevent diluent fluid flow to the peripheral passage 408 and eventually to the flow valve 366. A comparatively high incoming pressure value of diluent flow may exert a first force against the confrontation surface 402 and may cause the valve 398 to open (FIG. 41); in other embodiments, the diluent flow may not necessarily cause the valve to open. Then, the diluent flow may pass through the peripheral passages 408 and to the back surface 404. At the back surface 404, the diluent flow may exert a second force against the back surface that is greater than the first force, thus causing the valve 398 to move toward its closed position (FIG. 42). Here, a comparatively smaller amount of diluent flow may pass beyond the sealing portion 410 and to the peripheral passages 408. A comparatively low incoming pressure value of diluent flow may cause a similar function as the high incoming pressure value, though the low incoming pressure value may not exert a force at the back surface 404 that is sufficient in value to cause the valve 398 to move toward its closed position.

The different designs, constructions, and components of the dispenser devices of the various figures may be incorporated with one another. For example, the passage components of FIGS. 31, 33, 34, and 38 may be incorporated in the dispenser device of FIG. 2; likewise, the pin and cutout construction of FIG. 5 may be incorporated in the dispenser device of FIG. 35.

The above description of embodiments of the invention is merely illustrative in nature and, thus, variations thereof are not to be regarded as a departure from the spirit and scope of the invention.

What is claimed is:

1. A dispensing device comprising:

a housing having an inlet, an outlet, and a fluid flow passage between the inlet and outlet such that the inlet and outlet are in fluid communication;

a sleeve completely enclosed in the housing, the sleeve rotatably fixed and linearly slidable relative to the housing;

an eductor completely enclosed in the housing and partially disposed in the sleeve, the eductor is rotatable relative to the sleeve and configured to direct an incoming diluent flow and an incoming concentrate to an intersection to produce a diluted fluid mixture;

a control knob positioned on one end of the housing being rotatably coupled to one end of the eductor, the control knob rotatable relative to the housing to align a fluid passage proximate to the one end of the eductor with the outlet to control a volume of the diluted fluid mixture through the outlet; and a slide and a trigger operatively linked to the sleeve thereby controlling movement of the sleeve, wherein:

the control knob is directly laterally adjacent to the outlet of the housing such that the outlet of the housing is positioned on an inner portion of the housing between the control knob and the inlet such that the outlet is offset and axially misaligned relative to an axial rotation of the control knob, and a backflow valve fixed to an inner diameter of the inlet of the housing.

2. The dispensing device of claim 1, wherein the sleeve comprises a nub, wherein, when the trigger is actuated, a portion of the trigger directly engages the nub to cause the sleeve to move linearly along a longitudinal axis of the eductor.

3. The dispensing device of claim 2, further comprising a flow valve disposed in the housing between the eductor and the inlet of the housing that is configured for opening and closing to respectively permit and prevent diluent flow adjacent an inlet of the eductor and wherein the sleeve is constructed and arranged to move linearly along the longitudinal axis of the eductor to cause the flow valve to open.

4. The dispensing device of claim 1, wherein the trigger is pivotally connected to the housing.

* * * * *